US008831454B2

(12) United States Patent
Hiratsuka et al.

(10) Patent No.: US 8,831,454 B2
(45) Date of Patent: Sep. 9, 2014

(54) IMAGE FORMING APPARATUS

(75) Inventors: Takashi Hiratsuka, Kawasaki (JP); Yasumi Yoshida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 38 days.

(21) Appl. No.: 13/529,560

(22) Filed: Jun. 21, 2012

(65) Prior Publication Data

US 2012/0328337 A1 Dec. 27, 2012

(30) Foreign Application Priority Data

Jun. 22, 2011 (JP) ..... 2011-138267

(51) Int. Cl.
*G03G 15/16* (2006.01)
*G03G 15/00* (2006.01)
*G03G 15/01* (2006.01)

(52) U.S. Cl.
CPC ..... *G03G 15/1615* (2013.01); *G03G 15/0189* (2013.01); *G03G 15/5054* (2013.01); *G03G 2215/00156* (2013.01); *G03G 2215/0158* (2013.01)
USPC ..... 399/66; 399/302

(58) Field of Classification Search
CPC ..... G03G 15/0189; G03G 15/1615; G03G 2215/00156; G03G 15/00164
USPC ..... 399/66, 302
See application file for complete search history.

(56) References Cited

U.S. PATENT DOCUMENTS 4,174,171 A * 11/1979 Hamaker et al. ..... 399/165
2009/0169274 A1* 7/2009 Suzuki et al. ..... 399/302
2010/0189475 A1* 7/2010 Atwood et al. ..... 399/302

FOREIGN PATENT DOCUMENTS

JP 2000-034031 A 2/2000
JP 2000-233843 A 8/2000

* cited by examiner

*Primary Examiner* — Benjamin Schmitt
(74) *Attorney, Agent, or Firm* — Fitzpatrick, Cella, Harper & Scinto

(57) ABSTRACT

An image forming apparatus includes a photosensitive drum; an image forming device for forming a toner image on the drum; an endless belt; first and second rollers supporting the belt; a first sensor for detecting a widthwise position of the belt; a first displacing device for displacing the first roller in accordance with an output of the first sensor; a second sensor for detecting a widthwise position of the belt; a second displacing device for displacing the second in accordance with an output of the second sensor; an adjuster for adjusting first and second reference positions such that a tangent line direction of the drum at a position at which the drum contacts the belt is parallel with a moving direction the belt.

8 Claims, 18 Drawing Sheets

IMAGE FORMING APPARATUS

FIELD OF THE INVENTION AND RELATED ART

The present invention relates to an electrophotographic image forming apparatus, in particular, a copying machine, a printer, facsimile machine, and the like.

An image forming apparatuses which transfers a toner image formed on its image bearing member, onto a sheet of recording medium, and fixes the toner image on the sheet of recording medium to the sheet of recording medium by applying heat and pressure to the sheet of recording medium and the toner image thereon, has been widely in use, and so has been an image forming apparatus which has multiple image bearing members and an image bearing belt (intermediary transfer belt, for example), and transfers multiple monochromatic toner images, different in color, onto a sheet of recording medium with the use of the image bearing belt. Some image forming apparatuses which have multiple image bearing members employ an image bearing belt, and multiple rollers for supporting the belt. Further, they uses a steering system which tilts one of the belt supporting rollers in order to keep the belt within a preset range, in terms of the direction perpendicular to the rotational direction of the image bearing member. (Japanese Laid-open Patent Application 2000-34031).

The image forming apparatus disclosed in Japanese Laid-open Patent Application 2000-34031 has an intermediary transfer belt, onto which multiple toner images are transferred from multiple photosensitive members, one for one. It controls its intermediary transfer belt in position, in terms of the direction of perpendicular to the rotational direction of the image bearing member, by tiling one of the belt supporting rollers, based on the output of a belt position sensor. However, using only one of the belt supporting rollers as the belt steering roller is problematic. That is, using of only one of the belt supporting rollers as the belt steering roller is sufficient to make the belt to converge to a preset position (referential position), but, it cannot correct the belt in the angle relative to the direction perpendicular to the rotational direction of the image bearing member. Therefore, an image forming apparatus which uses two belt steering rollers (two of belt supporting rollers, for example) has been proposed (Japanese Laid-open Patent Application 2000-233843).

The apparatus disclosed in Japanese Laid-open Patent Application 2000-233843, which has multiple photosensitive members, has first and second steering devices which have first and second belt position sensors, respectively. The first belt sensor is on one side of the group of photosensitive members in terms of the moving direction of the belt, and the second belt sensor is on the other side. Theoretically, therefore, the belt can be kept stable in its angle relative to the rotational direction of the photosensitive members, by using the first and second steering devices to make the belt converge to the first and second referential positions, respectively.

The above-described image forming apparatus, which employs two belt steering rollers to control its image bearing belt in the belt position in terms of the rotational direction of the photosensitive drums, can keep stable the belt angle relative to the rotational direction of the photosensitive drums with the reference to the pair of belt position sensors. However, if the moving direction of the belt becomes angled relative to the rotational direction of the photosensitive members, a diagonally deformed image is formed on the belt, even when the belt is kept stable in its moving direction relative to the pair of belt position sensors. Thus, as multiple toner images are sequentially transferred in layers onto the belt from multiple photosensitive members, one for one, the toner images become misaligned in terms of the rotational direction of the photosensitive drums.

It is possible that not only does the image bearing belt become tilted relative to the rotational direction of the image bearing members, as the belt unit which includes belt position sensors is replaced, but also, even when the belt unit is not replaced, that is, when the belt unit is temporarily removed from the main assembly of an image forming apparatus and is reinstalled after it is checked and/or cleaned.

Thus, it has been proposed to provide the main frame of an image forming apparatus, to which the multiple photosensitive members are attached, with a device dedicated to the detection of the belt angle relative to the rotational direction of the image bearing members. However, this proposal is contradictory to the effort to reduce an image forming apparatus in cost and size, in that it adds to an image forming apparatus, a device (dedicated to detection of belt angle) which is not mandatory for image formation.

It has also been proposed to provide an image forming apparatus with a mechanism dedicated to adjust in angle the entirety of the belt unit as it is detected that the belt angle exceeds its acceptable range. This proposal also is contradictory to the effect to reduce an image forming in cost and size, in that it also requires to add to an image forming apparatus, a mechanism dedicated to the micro-adjustment of the angle of the entirety of the belt unit).

SUMMARY OF THE INVENTION

Thus, the primary object of the present invention is to provide an image forming apparatus capable of evaluating the angle of its belt relative to the rotational direction of its photosensitive members, without requiring a device dedicated to the detection of the angle of its belt relative to the rotational direction of the photosensitive members.

Another object of the present invention is to provide an image forming apparatus which does not have a device dedicated to the correction in angle its image bearing belt, and a device dedicated to the detection of the angle of the image bearing belt, and yet, is capable of quickly correcting in angle the image bearing belt, as it is detected that the belt angle relative to the rotational direction of the photosensitive drums is large enough to negatively affect image formation without requiring.

According to an aspect of the present invention, there is provided an image forming apparatus comprising a photosensitive member; an image forming device for forming a toner image on said photosensitive member; an endless belt movable in contact with said photosensitive member; a first roller and a second roller rotatably supporting said endless belt; a first sensor for detecting a position of said endless belt with respect to a widthwise direction thereof; a first displacing device for displacing said first roller in accordance with an output of said first sensor so that said endless belt is kept at a first reference position with respect to the widthwise direction; a second sensor for detecting a position of said endless belt with respect to the widthwise direction; a second displacing device for displacing said second in accordance with an output of said second sensor so that said endless belt is kept at a second reference position with respect to the widthwise direction; and an adjuster for adjusting the first reference position and the second reference position such that a tangent line direction of said photosensitive member at a position at which said photosensitive member contacts said endless belt is substantially parallel with a moving direction of a region of said endless belt which contacts said photosensitive member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings.

<Image Forming Apparatus>

Figure 1:
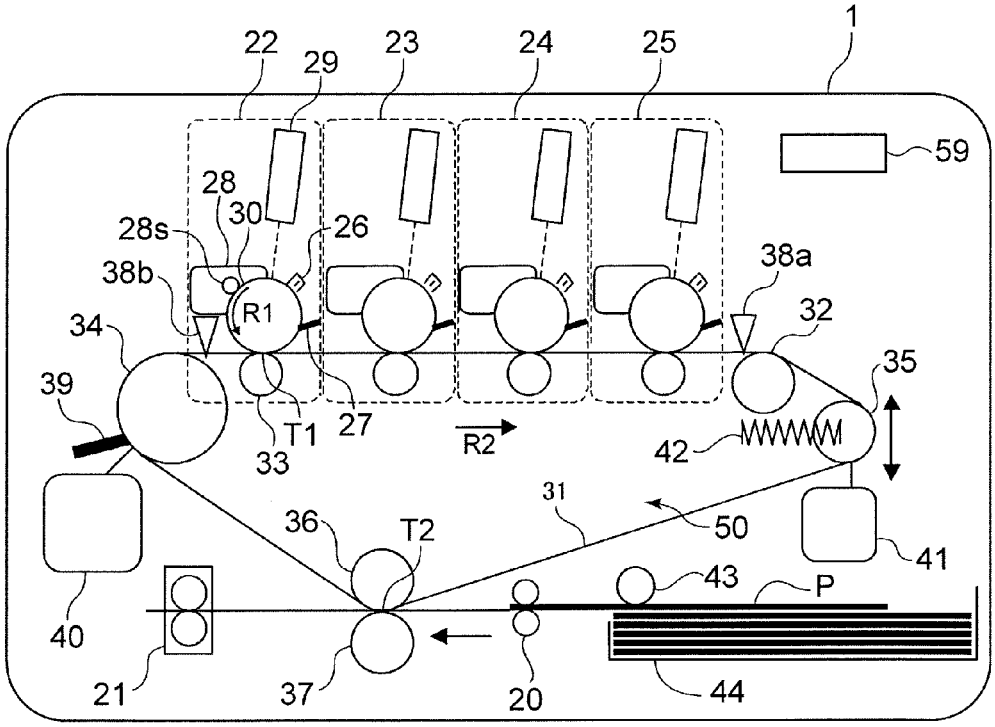
FIG. 1 is a schematic sectional view of the image forming apparatus in the first embodiment of the present invention, and shows the general structure of the apparatus.

FIG. 1 is a schematic sectional view of one of the typical image forming apparatuses to which the present invention is related. It shows the general structure of the apparatus. Referring to FIG. 1, the image forming apparatus 1 is a full-color printer of the so-called tandem type, and also, of the so-called intermediary transfer type. It has an intermediary transfer belt 31, and yellow, magenta, cyan and black image forming stations 22, 23, 34 and 25, respectively. The four image forming stations are aligned along the intermediary transfer belt 31.

In the image forming station 22, a yellow toner image is formed on a photosensitive drum 30, and is transferred onto the intermediary transfer belt 31. In the image forming station 23, a magenta toner image is formed through the procedure similar to that used in the image forming station 22, and is transferred onto the intermediary transfer belt 31 in such a manner that the magenta toner image is layered on the yellow toner image on the intermediary transfer belt 31. In the image forming stations 24 and 25, cyan toner image and black toner image, respectively, are formed through the procedure similar to that used in the image forming stations 22, and are sequentially transferred onto the intermediary transfer belt 31 in such a manner that the cyan and black toner images are sequentially layered onto the yellow and magenta toner images on the intermediary transfer belt 31.

The four toner images, different in color, on the intermediary transfer belt 31 are conveyed to the secondary transfer station T2, and are transferred together (secondary transfer) onto a sheet P of recording medium in the secondary transfer station T2. After the transfer (secondary transfer) of the four toner image, different in color, onto the sheet P of recording medium, the sheet P is separated from the intermediary transfer belt 31, with the utilization of the curvature of the intermediary transfer belt 31, and then, is sent into the fixing device 21 of the image forming apparatus 1. The fixing device fixes (welds) the toner images on the sheet P to the surface of the sheet P by applying heat and pressure to the sheet P and the toner images thereon. Thereafter, the sheet P is discharged from the image forming apparatus.

The image forming stations 22, 23, 24 and 25 are the practically the same in structure, although they are different in the color (yellow, magenta, cyan, and black, respectively) of the toner their developing device uses. Therefore, the process for forming a toner image is described with reference to the image forming station 22, that is, the yellow image forming station. The process for forming toner image in the image forming stations 23, 24 and 25 will not be described for the sake of not repeating the same description.

The image forming stations 22 has the photosensitive drum 30. It has also a charging device 26 of the corona type, an exposing device 29, a developing device 28, and a drum cleaning device 27, which are in the adjacencies of the peripheral surface of the photosensitive drum 30. These devices function as image forming devices. The image forming apparatus 1 has also a transfer roller 33, which opposes the photosensitive drum 30. The photosensitive drum 30 has a photosensitive surface layer which is negatively chargeable. It is rotated at a preset process speed in the direction indicated by an arrow mark R1. The charging device 26 of the corona type bombards the peripheral surface of the photosensitive drum 30 with the charged particles resulting from corona discharge, whereby the peripheral surface of the photosensitive drum 30 is negatively charged to a preset potential level VD (which is equal to potential level of unexposed area of latent image). The exposing device 29 writes on the peripheral surface of the photosensitive drum 30, an electrostatic latent image of the image to be formed, by scanning the charged area of the peripheral surface of the photosensitive drum 30 with a beam of laser beam while modulating (turning on or off) the beam of laser light according to the image formation data obtained by unfolding the data of the yellow color component obtained by separating the image to be formed, into the primary color components of the image to be formed.

The developing device 28 makes it development sleeve 28*s* bear two-component developer made up of nonmagnetic toner and magnetic carrier, while charging the developer. It conveys the charged developer to the area in which virtually no space is present between the peripheral surface of the development sleeve 28*s* and peripheral surface of the photosensitive drum 30. Further, to the development sleeve 28*s*, a preset oscillatory voltage, which is a combination of DC and AC voltages, is applied, whereby the negatively charged nonmagnetic toner is made to transfer onto the exposed points of the peripheral surface of the photosensitive drum 30, which are positive in potential relative to the charged toner. Consequently, the electrostatic latent image on the peripheral surface of the photosensitive drum 30 is reversely developed.

The image forming apparatus 1 is structured so that the transfer roller 33 is kept pressed against the peripheral surface of the photosensitive drum 30, with the presence of the intermediary transfer belt 31 between the transfer roller 33 and photosensitive drum 30, being thereby pressed upon the inward surface of the intermediary transfer belt 31, and forming thereby a transfer station T1 between the peripheral surface of the photosensitive drum 30 and intermediary transfer belt 31. To the transfer roller 33, a preset positive voltage is applied, whereby the toner image on the peripheral surface of the photosensitive drum 30 is transferred onto the intermediary transfer belt 31. The drum cleaning device 27 recovers the toner having escaped from being transferred onto the intermediary transfer belt 31, and therefore, remaining on the peripheral surface of the photosensitive drum 30 after the toner image transfer, by rubbing (scraping) the peripheral surface of the photosensitive drum 30 with its cleaning blade.

The secondary transfer roller 37 is on the outward side of the loop which the intermediary transfer belt 31 forms. It is pressed against a roller 36, which opposes the secondary transfer roller 37 from the inward side of the loop, forming thereby the second transfer station T2. The image forming apparatus 1 has a recording medium cassette 44, in which multiple sheets of recording medium are storable. Each sheet P of recording medium in the cassette 44 is taken out of the cassette 44 while being separated from the rest by a separation roller 43. Then, it is sent to a pair of registration rollers 20, which send the sheet P to the secondary transfer station T2 with such a timing that the sheet P arrives at the secondary transfer station T2 at the same time as the full-color image (made up of layered four monochromatic toner images different in color) on the intermediary transfer belt 31. Then, the toner images and sheet P of recording medium are conveyed together (in layers) through the secondary transfer station T2, while positive voltage is applied to the secondary transfer roller 37. Consequently, the full-color is transferred from the intermediary transfer belt 31 onto the sheet P. The toner which failed to be transferred onto the sheet P, that is, the toner remaining on the intermediary transfer belt 31 after the secondary transfer, is recovered by the belt cleaning device 39.

<Belt Unit>

Figure 2:
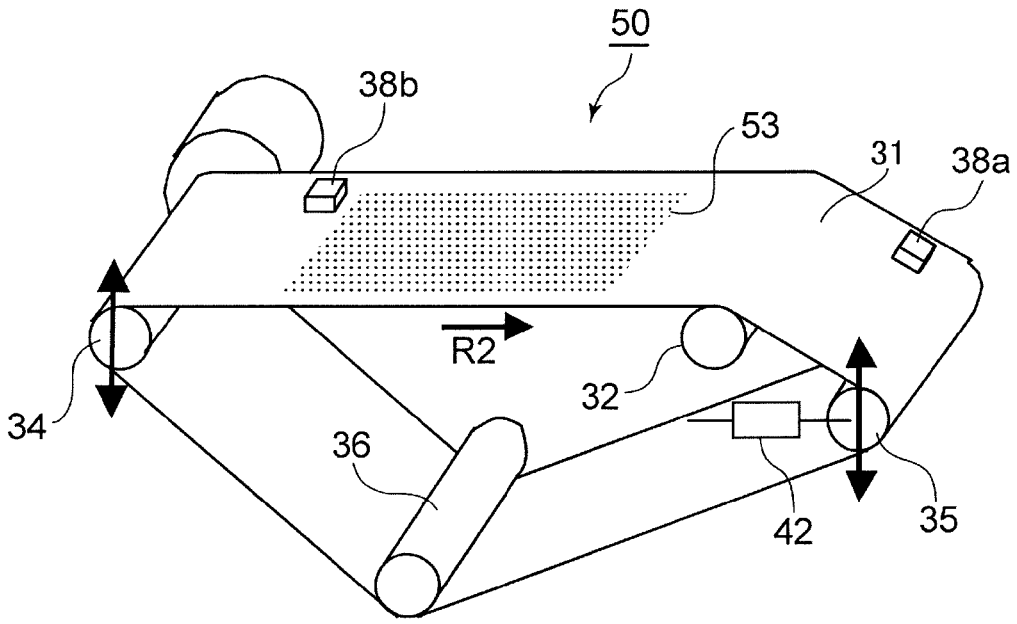
FIG. 2 is a perspective view of the intermediary transfer unit of the image forming apparatus in the first embodiment.
Figure 3:
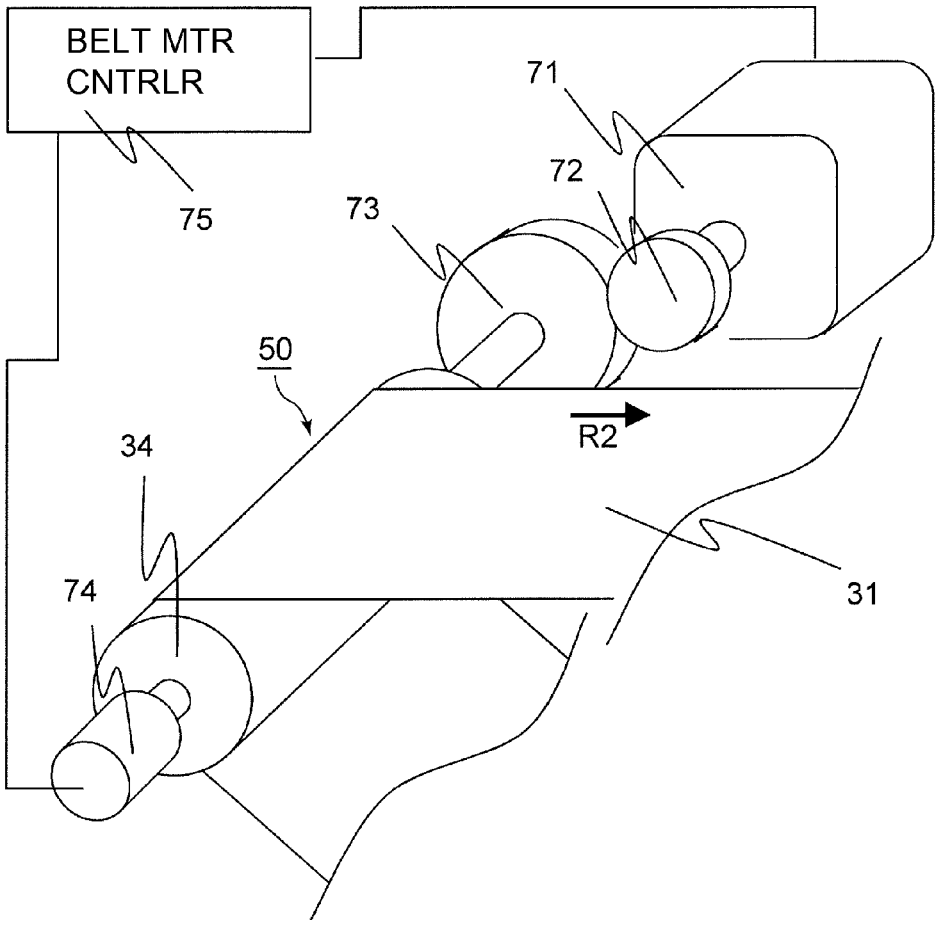
FIG. 3 is a schematic perspective view of the system for driving the intermediary transfer belt, and shows the general structure of the system.

FIG. 2 is a perspective view of the intermediary transfer unit 50. FIG. 3 is a schematic drawing for describing the system for driving the intermediary transfer belt 31. Referring to FIG. 2, the intermediary transfer unit 50 is removable from the image forming apparatus (1 in FIG. 1). The intermediary transfer belt 31 of the intermediary transfer unit 50 is supported by a belt driving roller (which hereafter may be referred to simply as driving roller 34), a follower roller 32, a belt steering roller 35 (which hereafter may be referred to simply as steering roller), a roller 36 (which opposes secondary transfer roller 37, and may be referred to simply as counter roller), and is circularly moved in the direction indicated by an arrow mark R2, by being driven by the belt driving roller 34. A spring mechanism 42 provides the intermediary transfer belt 31 with a preset amount of tension, by keeping the steering roller 35 outward of the loop which the intermediary transfer belt 31 forms.

Referring to FIG. 3, the intermediary transfer unit 50 has a motor 71 for driving the intermediary transfer belt 31. It has also an intermediary transfer belt driving gear 72, which is solidly attached to the drive shaft of the intermediary transfer belt driving motor 71. Further, the intermediary transfer unit 50 has also a driver roller gear 73, which is solidly attached to the shaft of the belt driving roller 34. The belt driving motor gear 27 is in mesh with the driving roller gear 73, whereby the torque of the intermediary transfer belt driving motor 71 is transmitted to the driving roller 34 through the gear trains made up of the abovementioned gears.

Attached to the opposite end of the driving roller 34 from the driving roller gear 73 is a belt rotary encoder 74, which employs a rotary encoder of the transmission type, which is commonly and widely in use and uses a disc with a slit. It detects the angular speed of the driving roller 34 with preset intervals. Outputted by the belt rotary encoder 74 are sequential pulses which are proportional to the angular speed of the driving roller 34.

The main assembly of the image forming apparatus (1: FIG. 1) is provided with a belt driving motor controller 75, which controls the speed of the intermediary transfer belt driving motor 71, based on the sequential pulses outputted from the belt rotary encoder 74 (feedback control). The target value for the speed of the motor 71 is optional. The belt driving motor controller 75 drives the intermediary transfer belt 31 at such a speed that the peripheral velocity of the photosensitive drum 30 is 1.0% faster than the moving speed of the intermediary transfer belt 31. The reason for this practice is for providing a minute amount of slip between the intermediary transfer belt 31 and the peripheral surface of the photosensitive drum 30 to improve the intermediary transfer unit 50 in transfer efficiency, that is, the efficiency with which a toner image is transferred from a photosensitive drum 30 onto the intermediary transfer belt 31. It is also for preventing the phenomenon that because the intermediary transfer unit 50 is structured so that the intermediary transfer belt 31 is pushed toward the group of photosensitive drums 30 by the driving roller 34, the intermediary transfer belt 31 is likely to be slacken as it is driven by the driving roller 34. The direction, and amount of the difference between the moving speed of the intermediary transfer belt 31 and the peripheral velocity of the photosensitive drum 30, which can be set with the use of the driving motor controller 75, is optional.

Referring to FIG. 2, the intermediary transfer unit 50 controls the intermediary transfer belt 31 in terms of lateral shift (deviation), by tilting the steering roller 35 and/or driving roller 34; it controls the intermediary transfer belt 31 in terms of lateral shift (deviation) at two points in terms of the circumferential direction of the intermediary transfer belt 31. More concretely, the intermediary transfer unit 50 is provided with a pair of sensors 38*a* and 38*b* for detecting the position of the intermediary transfer belt 31 in terms of the direction perpendicular to the rotational direction of the photosensitive drum 30. Hereafter, the sensors 38*a* and 38*b* may be referred to simply as the first and second belt position sensors, respectively. The first belt position sensor 38*a* is near the steering roller 35, and the second belt position sensor 38*b* is near the belt driving roller 34.

<Belt Position Sensor>

Figure 4:
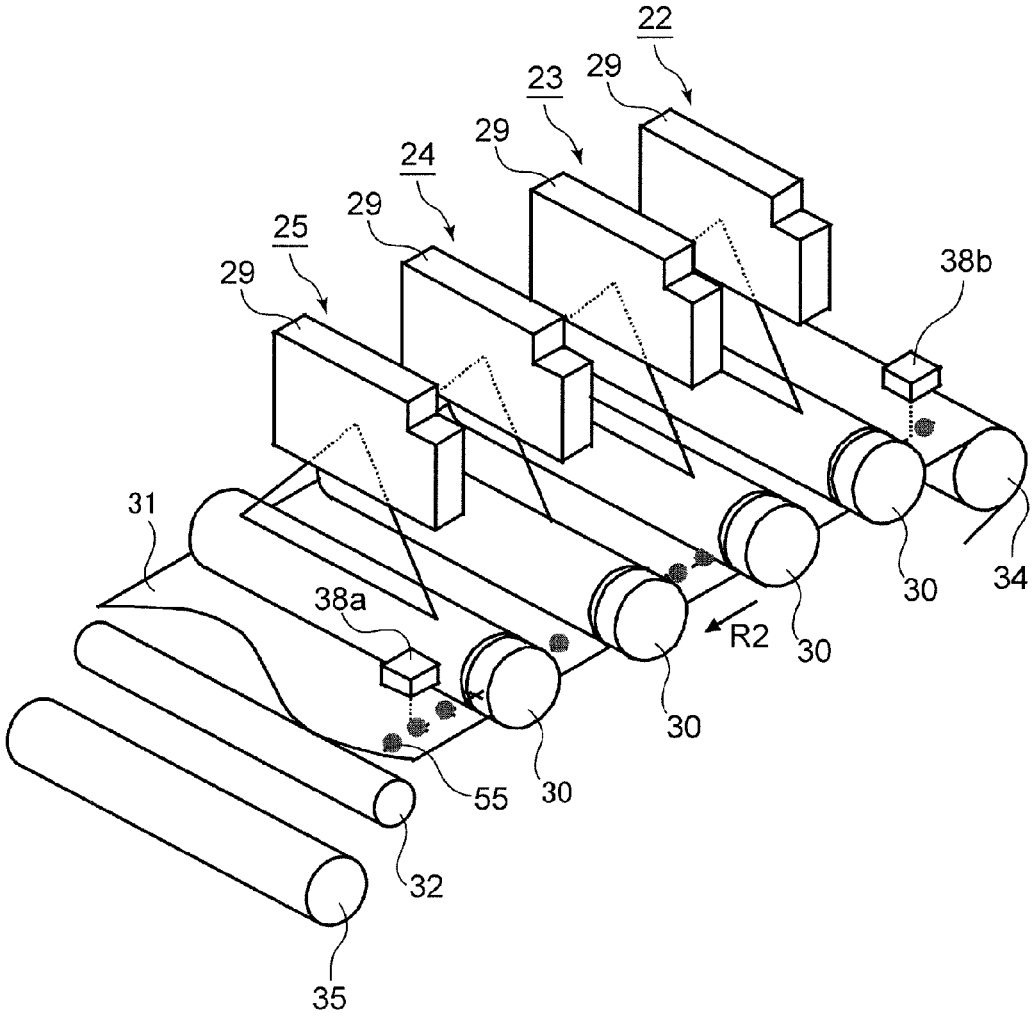
FIG. 4 is a schematic drawing for showing the positioning of the belt position sensors in the first embodiment.
Figure 5:
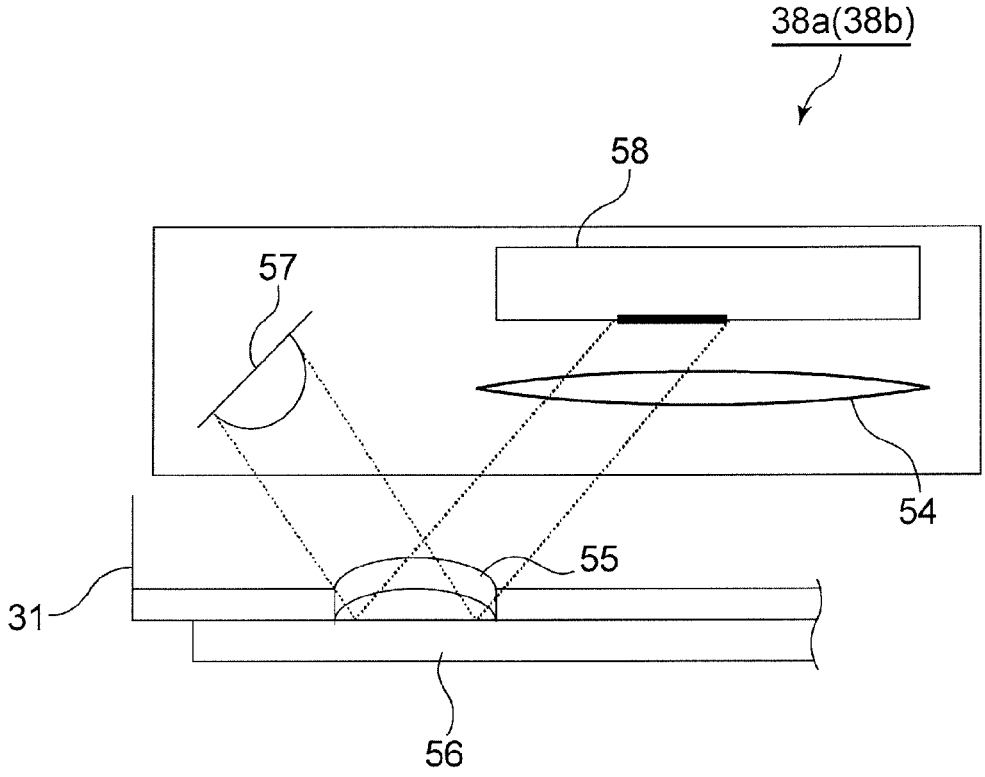
FIG. 5 is a schematic drawing of one of the belt position sensors, and shows the general structure of the sensor.

FIG. 4 is a drawing for describing the position of the belt position sensors. FIG. 5 is a drawing for describing the structure of one of the belt position sensors.

Referring to FIG. 4, in terms of the widthwise direction of the intermediary transfer belt 31, the first and second belt position sensors 38*a* and 38*b* are within the path of the intermediary transfer belt 31. In terms of the moving direction of the intermediary transfer belt 31, the first and second belt position sensors 38*a* and 38*b* are between the driving roller 34 and steering roller 35, with the presence of a preset distance between the two sensors 38*a* and 38*b*. More precisely, the first sensor 38*a* is between the driving roller 34 and the yellow image forming station 22. The second sensor 38*b* is between the black image forming station 25 and steering roller 35.

The intermediary transfer belt 31 is provided with multiple circular patterns 55, which are aligned with preset intervals along one of the edges of the intermediary transfer belt 31. Each pattern 55 in this embodiment is a round hole (perforation). More specifically, in order to accurately detect the belt position in terms of the rotational direction of the photosensitive drum 30, the intermediary transfer belt 31 is provided with circular openings, which are 100 μm in diameter and 5 mm in interval. The openings are aligned along one of the edges of the intermediary transfer belt 31. They are formed with the use of a laser.

The first and second sensors 38*a* and 38*b* detect the circular patterns 55, which are different in position from each other in terms of the moving direction of the intermediary transfer belt 31. As they detect the patterns 55, they output signals which correspond to the position of the intermediary transfer belt 31 in terms of the direction perpendicular to the rotational direction of the photosensitive drum 30. The first and second sensors 38*a* and 38*b* are near the two rollers, one for one, which support the intermediary transfer belt 31. Therefore, they can reliably detect the position of the intermediary transfer belt 31, because it is the adjacencies of the roller by which the intermediary transfer belt 31 is supported that the intermediary transfer belt 31 is highest in rigidity. Further, the first and second sensors 38*a* and 38*b* are near the steering roller 35 and the second sensor 38*b*, respectively. Therefore, there is a sufficient distance between the first and second sensors 38*a* and 38*b*, for precisely detecting the amount of the skewness of the intermediary transfer belt 31, which will be described later.

The first and second sensors 38*a* and 38*b* are the same in structure. Therefore, the structure of only the first sensor 38*a* is described in order not to repeat the repeat the same description.

Referring to FIG. 5, the first sensor 38*a* is made up of a light sensor 58, a lens 54, and a light source 57. Located on the opposite side of the intermediary transfer belt 31 from the first sensor 38*a* is a reflective plate 56. The light source 58 is a red LED. The light sensor 58 is a two-dimensional area sensor which is VGA (640×480) in resolution. As the lens 54 projects the image of the pattern 55, it magnifies the pattern 55 by 10 times. Thus, the pattern 55 on the intermediary transfer belt 31, which is 1 μm in diameter, is enlarged to the size of one pixel. In order to prevent the fluttering of the intermediary transfer belt 31 from affecting the focusing of the pattern 55 on the light sensor 58 by the lens 54, a telecentric optical system, that is, such an optical system that its primary ray and optical axis are parallel is used.

As the first sensor 38*a* detects the pattern 55, it digitizes the image photographed by the light sensor 58, and calculates the area center coordinate (two dimensional) of the digitized image of the photographed pattern 55. The amount of the lateral deviation of the intermediary transfer belt 31 can be obtained by extracting only the coordinate of the pattern 55 in the direction perpendicular to the rotational direction of the photosensitive drum 30.

Incidentally, the first and second sensors 38*a* and 38*b* may be of the contact or non-contact type. Further, their positions do not need to be limited to those shown in FIG. 4. Moreover, the patterns 55 may be in the form of a cross or the like. They may be precisely cut through the intermediary transfer belt 31 when the intermediary transfer belt 31 is manufactured, or toner images transferred onto the intermediary transfer belt 31 from a photosensitive drum 30.

<Steering Mechanism>

Figure 6:
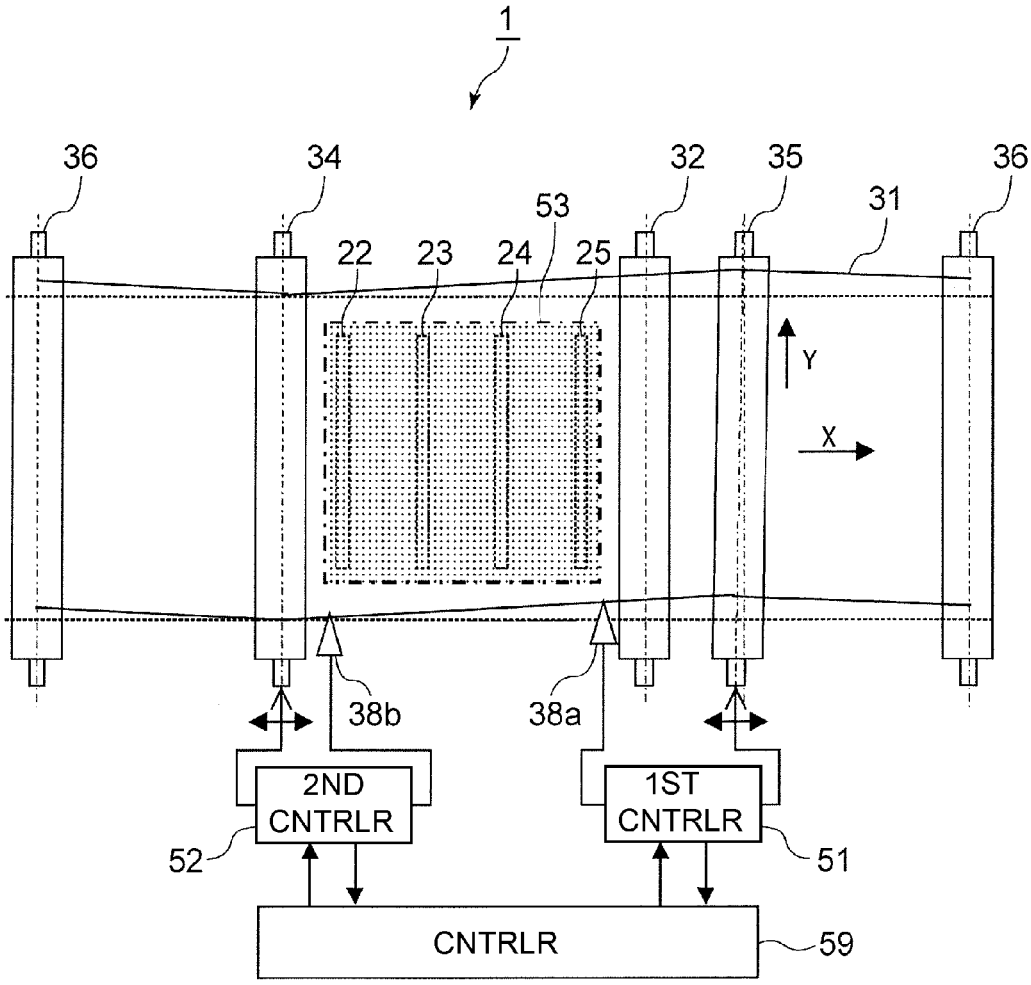
FIG. 6 is a schematic drawing of the belt position control system, in the first embodiment, which uses a pair of belt steering rollers. It shows the general structure of the control system.
Figure 7:
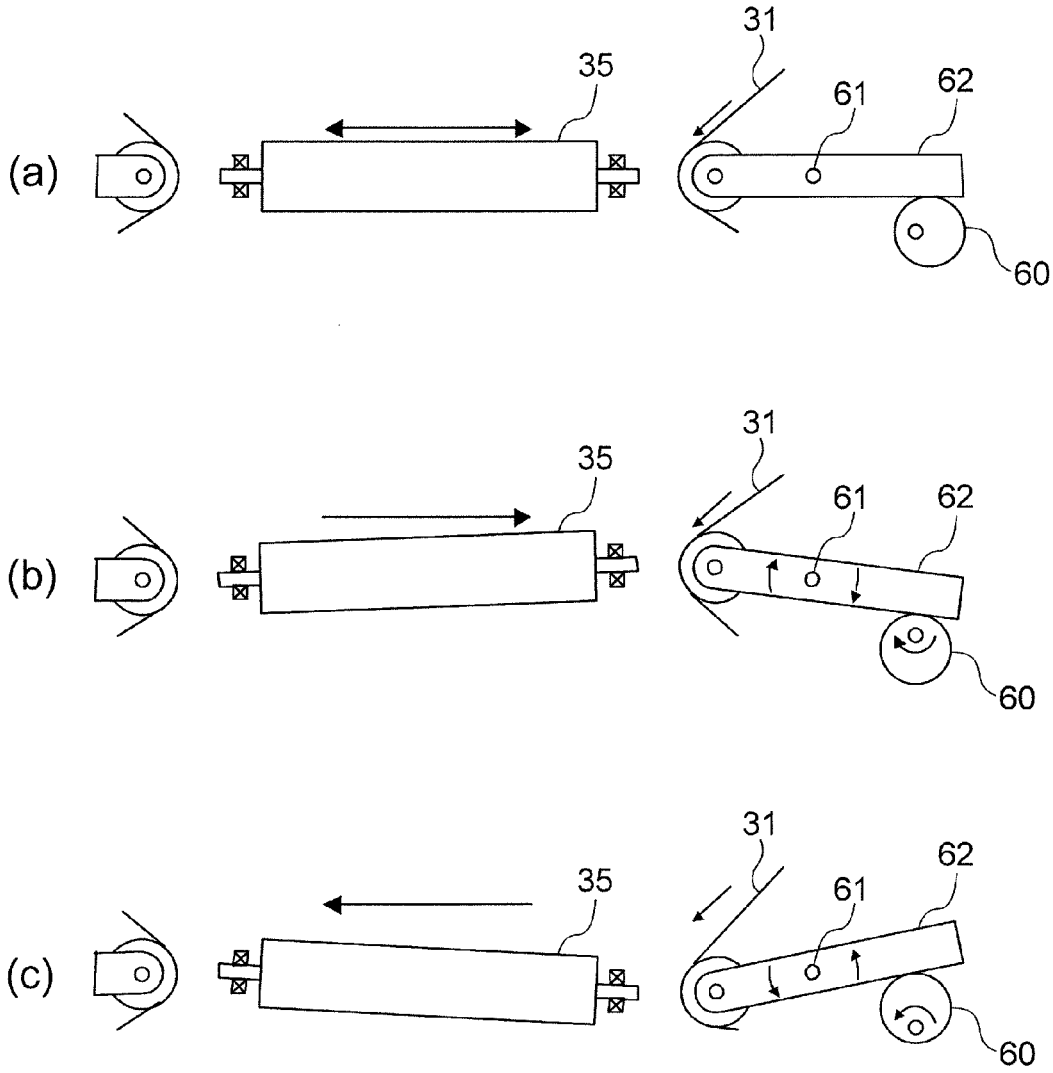
FIG. 7 is a schematic drawing of the mechanism for tilting one of the belt steering rollers, and shows how the mechanism tilts the belt steering roller.

FIG. 6 is a schematic drawing for describing the belt position control system which controls the intermediary transfer belt 31 in position in terms of the direction perpendicular to the rotational direction of the photosensitive drum 30. The belt position control system uses a pair of belt steering rollers. FIG. 7 is a schematic drawing for describing the mechanism (steering device) for tilting a steering roller.

Referring to FIG. 6, the portion of the belt path, which extends from the driving roller 34 to the steering roller 35, goes around the steering roller 35, and extends further back to the driving roller 34, can be theoretically unfolded flatly, by cutting the belt unit 50 at the axial line of the counter roller 36. The mechanism for tilting the steering roller 35, and the mechanism for tilting the driving roller 34, are practically the same in structure. Thus, only the mechanism for enabling the belt unit 50 to control the belt deviation by tilting the steering roller 35 is concretely described; the mechanism for enabling the driving roller 34 to control the lateral belt deviation is not described here.

Referring to FIG. 7(*a*), one of the lengthwise ends of the steering roller 35 is rotatably supported by one end of an oscillatory arm 62, whereas the other lengthwise end of the steering roller 35 is supported so that it is allowed to move in an oscillatory manner. The oscillatory arm 62 is rotatably supported at its center portion by a shaft 61. The opposite end portion of the oscillatory arm 62 from the steering roller 35 is kept pressed upon the peripheral surface of an eccentric cam 60, which is in connection to the rotational shaft of the steering roller tilting motor 41.

Next, referring to FIG. 7(*b*), as the eccentric cam 60 is rotated by the steering roller tilting motor 41 in the CW (clockwise) direction, the oscillatory arm 62 also is moved in the CW (clockwise) direction. Thus, the rear side of the steering roller 35 is displaced upward, causing thereby the intermediary transfer belt 31 to shift rearward.

Next, referring to FIG. 7(*c*), as the eccentric cam 60 is rotated by the steering control motor 41 in the CCW (counterclockwise) direction, the oscillatory arm 62 also is moved in the CCW (counterclockwise) direction. Thus, the rear side of the steering roller 35 is displaced downward, causing thereby the intermediary transfer belt 31 to shift frontward.

By controlling the steering roller 35 in the direction and amount of its tilt (angle) as described above, it is possible to control the intermediary transfer belt 31 in the amount of lateral shift at the location of the steering roller 35. Similarly, by controlling the driving roller 34 in the direction and amount of its tilt, it is possible to control the intermediary transfer belt 31 in the amount of its lateral shift, at the location of the driving roller 34. Thus, by controlling the position of the intermediary transfer belt 31, in terms of the rotational direction of the photosensitive drum, at the location of the location of the steering roller 35 and the location of the steering roller 34, it is possible to control the attitude (moving direction) of the intermediary transfer belt 31.

Referring to FIG. 6, the image forming apparatus 1 controls the intermediary transfer belt 31 in position in terms of the direction perpendicular to the rotational direction of the photosensitive drum, so that the value which indicates the belt position detected by the first sensor 38*a* and the value which indicates the belt position detected by the second sensor 38*b* converge to P1 and P2 , respectively, whereby the intermediary transfer belt 31 is regulated in latitude in terms of its attitude (angle). The image forming apparatus 1 controls the intermediary transfer belt 31 in both the amount of lateral shift and attitude at the same time, by using the steering roller 35 and driving roller 34. That is, it controls the intermediary transfer belt 31 in both the amount of lateral shift and attitude at the same time, by indirectly correcting the intermediary transfer belt 31 in attitude by controlling the intermediary transfer belt 31 in the amount of lateral shift and attitude using the steering roller 35 and driving roller 34.

The first controller 51 calculates the belt position Y1 at the first sensor 38*a* in terms of the direction perpendicular to the rotational direction of the photosensitive drum 30, based on the data of the photographed image of the pattern 55, which are sent from the first sensor 38*a*. Then, it computes the angle by which the steering roller tilting motor (41: FIG. 1) is to be rotated, based on the difference (distance) between the stored target position P1 at the first sensor 38*a*, and the detected belt position Y1. Then, it tilts the steering roller 35 by rotating the steering roller tilting motor 41 by the computed angle. This operational sequence is repeated with preset intervals to correct the intermediary transfer belt 31 in position (Y1) at the location of the first sensor 38*a*. Thus, the Y1 converges toward P1, roughly coinciding with P1 eventually. That is, the first controller 51 actively controls the steering roller 35 by computing, with the use of the PID algorithm, the amount by which the steering roller tilting motor 41 is to be rotated, based on the amount of difference (distance) between the position Y1 and position P1.

The second controller 52 controls the amount by which the driving roller 34 is to be tilted, through the same operational sequence as that which the first controller 51 follows to control the amount by which the steering roller 35 is to be tilted. That is, it calculates the belt position Y2 at the location of the second sensor 38*b* in terms of the direction perpendicular to the rotational direction of the photosensitive drum 30, based on the data of the photographed image of the pattern 55, which are sent from the second sensor 38*b*. Then, it computes the angle by which the driving roller tilting motor (40: FIG. 1) is to be rotated, based on the difference (distance) between the stored target position P2 at the second sensor 38*b*, and the detected belt position Y2. Then, it tilts the driving roller 34 by rotating the driving roller tilting motor 40 by the computed angle. This operational sequence is repeated with preset intervals to correct the intermediary transfer belt 31 in the position (Y2) at the location of the second sensor 38*b*. Thus, the Y2 converges toward P2, roughly coinciding with P2 eventually.

<Steering Control during Image Formation>

Figure 8:
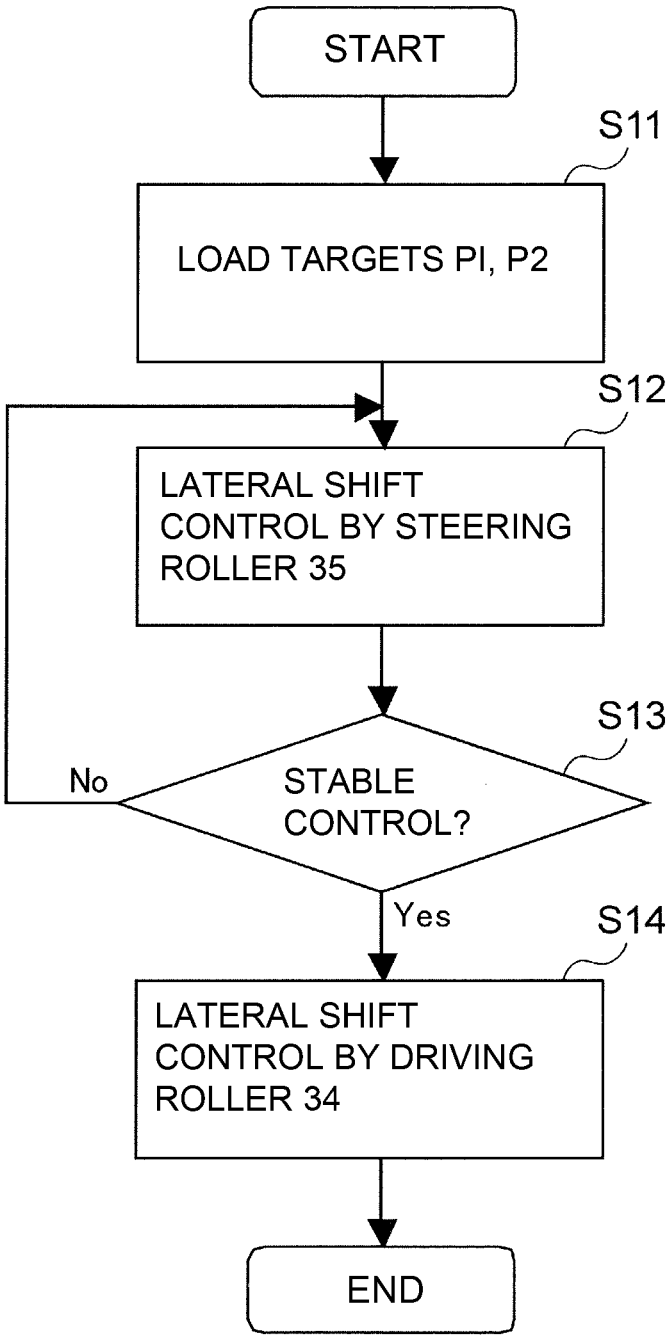
FIG. 8 is a flowchart of the control sequence for controlling, in attitude, the intermediary transfer belt during an image forming operation.

FIG. 8 is a flowchart of the control sequence for controlling the intermediary transfer belt 31 in attitude during image formation. Referring to FIG. 8 along with FIG. 6, the ordinary sequence for controlling the lateral deviation of the intermediary transfer belt 31, and the ordinary sequence for correcting the intermediary transfer belt 31 in attitude, are carried out during image formation.

As the image forming apparatus 1 receives an image formation start command, the first controller 51 loads the target value P1 for the belt position at the first sensor 38*a*, and the second controller 52 loads the target value P2 for the belt position at the second sensor 38*b* (S11).

First, the control section 59 activates the first controller 51 to use only the steering roller 35 to control the intermediary transfer belt 31 in lateral shift so that the value of the belt position Y1 at the first sensor 38*a* converges to the target value P1 (S12). The first controller 51 uses PID (proportional-plus-integral-plus-derivative) control as the algorithm for controlling the intermediary transfer belt 31 in lateral deviation. PID is an algorithm which is widely in use in the field of control engineering.

Defining that the position Y1 of the intermediary transfer belt 31 in terms of the direction perpendicular to the rotational direction of the photosensitive drum 30 at a point t in time is Y(t), the angle S1 (t) of the steering roller 35 at point t in time can be expressed by the following equation:

$$S1(t)=Kp(P1-Y1(t))+Ki\int(P1-Y1(t))+Kd\cdot d(P1-Y1(t))/dt \quad (1)$$

Kp, Ki and Kdt stand for proportional gain, integral gain, and differential gain, respectively. The values for these parameters are determined in consideration of the stability, performance, etc., of the apparatus.

Next, it is determined whether or not the intermediary transfer belt 31 is stable in position and angle at the point t in time (S13). In this embodiment, whether or not the value of the belt position Y1 detected by the first sensor 38*a* remains in a range of P1±5% was used as a criterion. If the intermediary transfer belt 31 is stable (Yes in S13), the intermediary transfer belt 31 is controlled in lateral shift at the driving roller 34 (with use of driving roller) so that the value of the belt position Y2 detected by the second sensor 38*b* converges to the target value P2 (S14). If the intermediary transfer belt 31 is not stable in position (No in S13), S12 is continued.

By the way, the sequence for controlling the intermediary transfer belt 31 in lateral shift and attitude during image formation does not need to be limited to that shown by the flowchart in FIG. 8. For example, it is possible to directly control the intermediary transfer belt 31 in attitude with the use of the driving roller 34 while controlling the intermediary transfer belt 31 with the use of the steering roller 35 as described above. In such a case, the second controller 52 calculates the belt angle, and controls the driving roller in angle based on the result of the calculation, assuming that the difference between the value of the belt position Y1 detected by the first sensor 38*a* and the value of the belt position Y2 detected by the second sensor 38*b* is equivalent to the belt angle (attitude).

Further, assuming that the difference between the value of the output signal of the first sensor 38*a* and the value of the output signal of the second sensor 38*b* is equivalent to the angle (attitude) of the intermediary transfer belt 31, the image forming apparatus 1 may be designed so that the first controller 51 calculates the belt angle, and controls the steering roller 35 in angle based on the result of the calculation. In other words, the method for controlling the intermediary transfer belt 31 in position (in terms of the direction perpendicular to the rotational direction of the photosensitive drum) and attitude during an ordinary image forming operation is optional.

<Angle of Intermediary Transfer Belt Relative to Rotational Direction of Photosensitive Drum>

Figure 9:
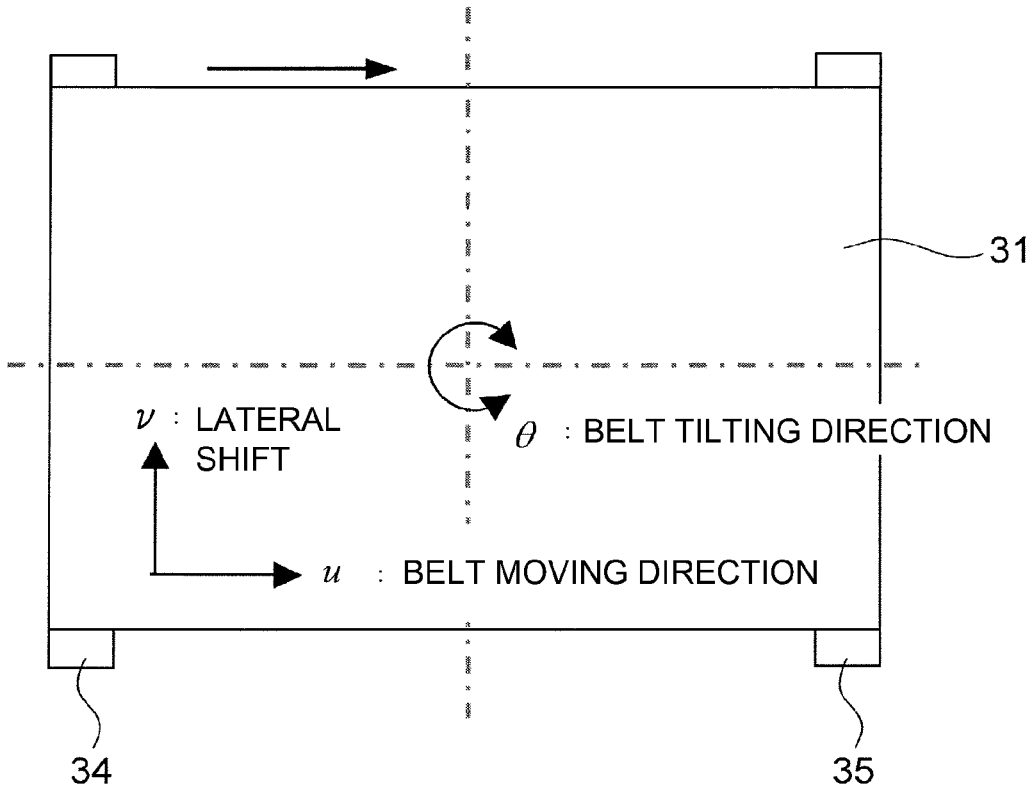
FIG. 9 is a drawing which gives the definition of the attitude of the intermediary transfer belt.
Figure 10:
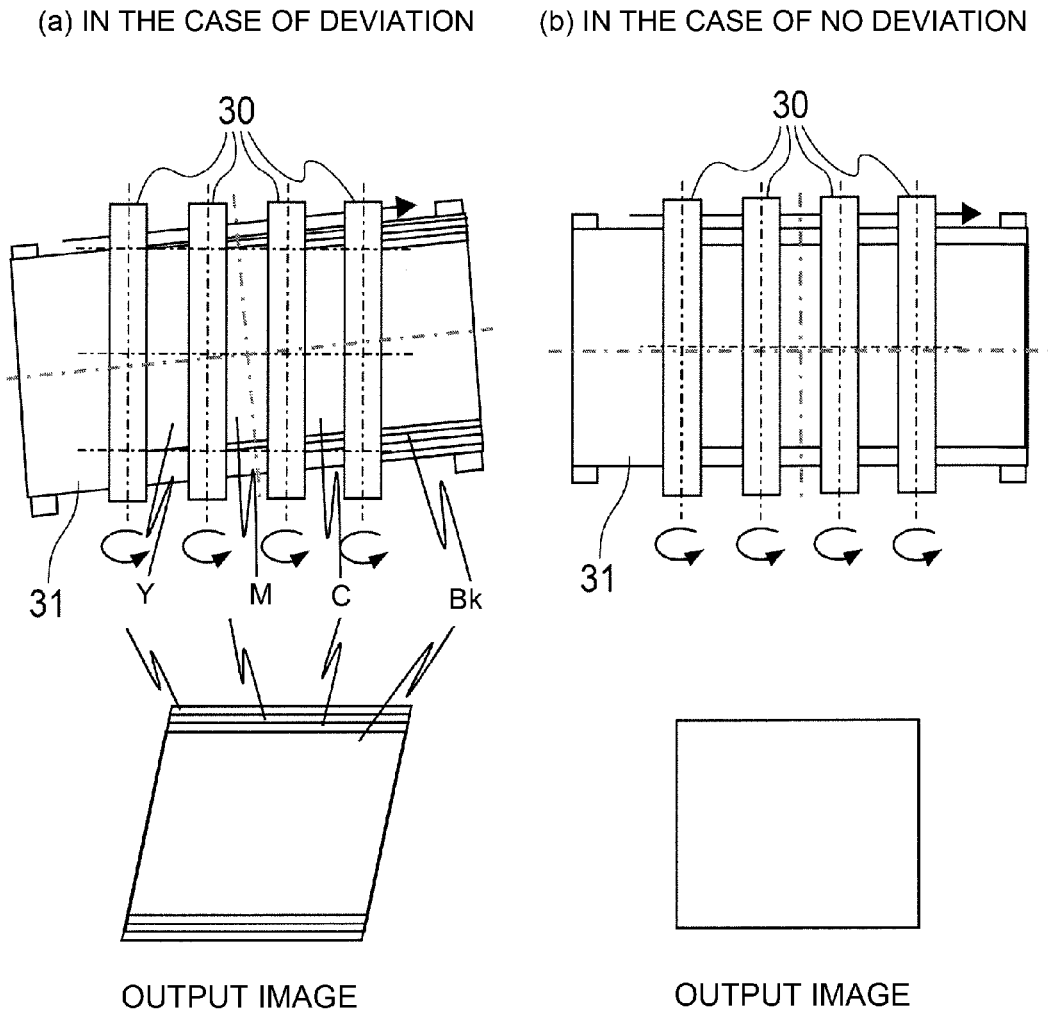
FIG. 10 is a drawing for describing the relationship between color deviation of an image, and the deformation of the image.

FIG. 9 is a drawing for giving the definition of "angle" of the intermediary transfer belt 31. FIG. 10 is a drawing for describing how the image forming apparatus 1 ends up outputting images which suffer from color deviation and/or deformation. Referring to FIG. 6, if the rotational direction R2 of the intermediary transfer belt 31 is angled relative to the rotational direction of the photosensitive drum 30 during an image forming operation, an image which suffers from color deviation is outputted on a sheet P of recording medium.

Given in FIG. 9 are the definition of the terms related to the lateral shift of the intermediary transfer belt 31, and the attitude of the intermediary transfer belt 31. Seeing the primary transfer surface of the intermediary transfer belt 31 from above, it is assumed that the intermediary transfer belt 31 is moved in the left-to-right direction. A letter u stands for the direction in which the area of the intermediary transfer belt 31 (primary transfer surface), which is in contact with the peripheral surface of the photosensitive drum 30, moves when the intermediary transfer belt 31 moves in the left-to-right direction, and a letter v stands for the direction in which the intermediary transfer belt 31 moves (shifts) in the direction perpendicular to the direction u. Further, a letter θ stands for the direction in which the intermediary transfer belt 31 rotates about the straight line which coincides with the center of the primary transfer surface and is perpendicular to the primary transfer surface.

The image forming apparatus 1 shown in FIG. 6 can correct the intermediary transfer belt 31 in attitude, as well as in the position in terms of the direction perpendicular to the rotational direction of the photosensitive drum 30. Therefore, as long as it can keep the intermediary transfer belt 31 in proper attitude, it can form an image which is free of deformation, on a sheet of recording medium. However, unless proper target value for controlling the intermediary transfer belt 31 in position in terms of the direction perpendicular to the rotational direction of the photosensitive drum 30 is set for the first and second controllers 51 and 52, images which suffer from color deviation and/or deformation are outputted.

Referring to FIG. 10(*a*), if the moving direction of the intermediary transfer belt 31 is angled relative to the rotational direction (tangential direction) of the photosensitive drum 30, a toner image on the photosensitive drum 30 is transferred onto the intermediary transfer belt 31 while the intermediary transfer belt 31 is gradually shifting in the direction in which the intermediary transfer belt 31 is angled relative to the rotational direction of the photosensitive drum 30. Therefore, as the toner image on the photosensitive drum 30 is transferred onto the intermediary transfer belt 31, the toner image is deformed in the shape of a parallelogram. Further, a toner image transferred onto the intermediary transfer belt 31 in the upstream image forming station of the adjacent two image forming stations is conveyed to the transfer station of the downstream station while being gradually moved in the direction in which the intermediary transfer belt 31 is angled. Then, the next toner image, which is different in color, are transferred onto the area of the intermediary transfer belt 31 having the toner image from the upstream image forming station. As a result, as the four toner images, different in color, are transferred in layers onto the intermediary transfer belt 31, they become misaligned in their primary scan direction. Therefore, the image forming apparatus 1 ends up outputting images which suffer from color deviation.

Referring to FIG. 10(*b*), if the moving direction of the intermediary transfer belt 31 is not angled relative to the rotational direction (direction of line tangential to peripheral surface of photosensitive drum 30), the direction in which a toner image on the photosensitive drum 30 moves while it is transferred onto the intermediary transfer belt 31 is parallel to the moving direction of the intermediary transfer belt 31. Therefore, the toner image is not deformed in the form of a parallelogram as it is transferred onto the intermediary transfer belt 31. Further, as a toner image transferred onto the intermediary transfer belt 31 in the upstream image forming station of the adjacent two image forming stations is conveyed to the downstream image forming station, it is not moved in the direction parallel to the direction perpendicular to the rotational direction of the photosensitive drum 30. Therefore, as it is transferred onto the intermediary transfer belt 31 in the downstream image forming station, it is layered on the toner image(s) on the intermediary transfer belt 31 with no misalignment. Thus, the color deviation attributable to the toner image misalignment in the primary scan direction does not occur.

If the intermediary transfer belt 31 is circularly moved in such an attitude that causes image deformation, there is a substantial amount of deviation between the moving direction of the peripheral surface of each of the photosensitive drums 30 in the image forming stations 22, 23, 24 and 25, and the moving direction of the intermediary transfer belt 31. This creates the following problem. That is, the amount of external disturbing force which acts on the intermediary transfer belt 31 increases, which in turn increases the length of time required to make the intermediary transfer belt 31 converge to a preset position. Thus, the belt unit 50 reduces in the performance of correcting the intermediary transfer belt 31 in position.

In each of the following embodiments of the present invention, therefore, in order to solve the problems such as those described above, a control sequence that can make the moving direction of the intermediary transfer belt 31 at the point of contact between the photosensitive drum 30 and intermediary transfer belt 31 roughly the same as (parallel to) the rotational direction of the photosensitive drum 30 at the point of contact between the photosensitive drum 30 and intermediary transfer belt 31 is provided.

<Embodiment 1>

Figure 11:
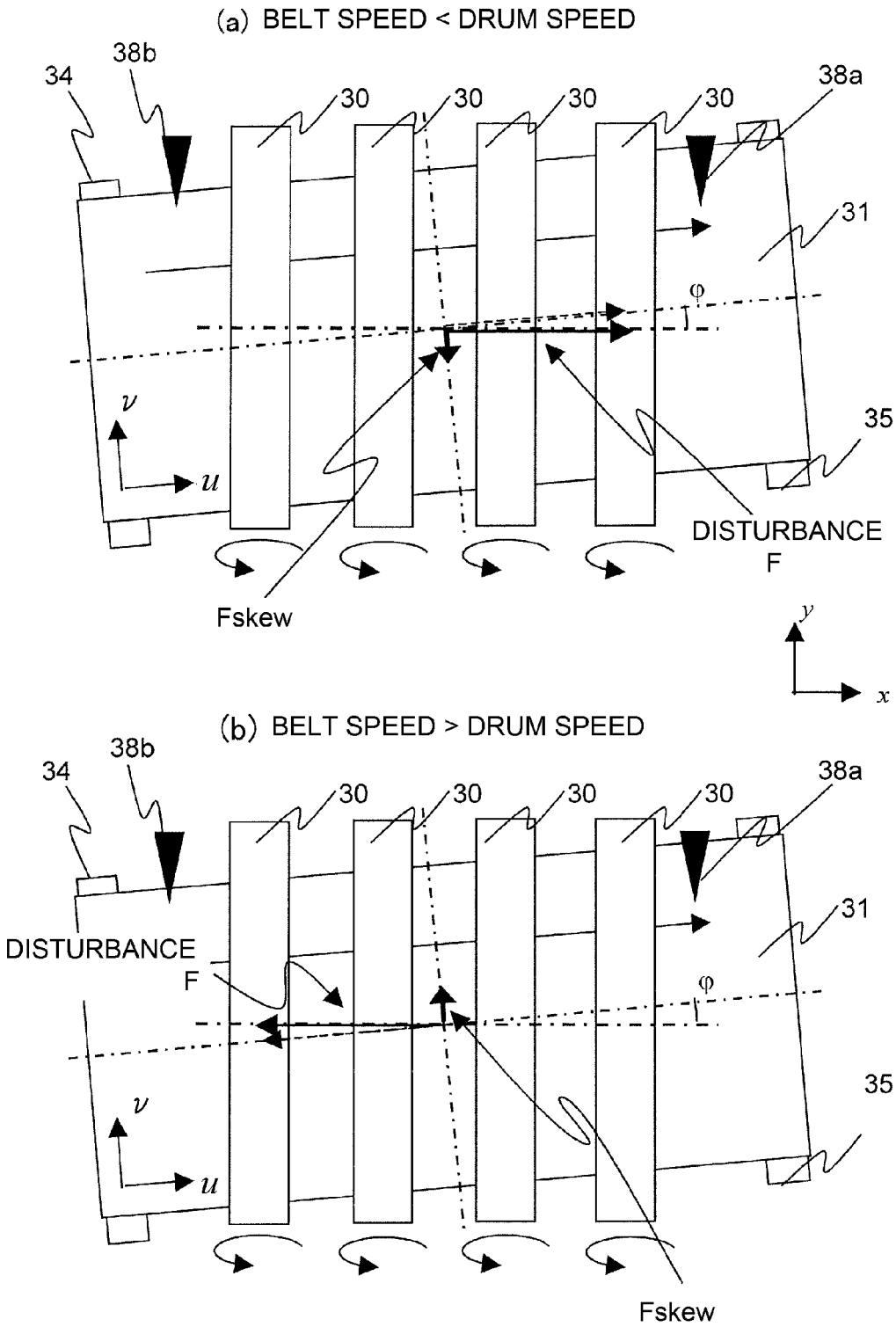
FIG. 11 is a drawing for describing how the speed of the intermediary transfer belt is made different from the peripheral velocity of the photosensitive drum.
Figure 12:
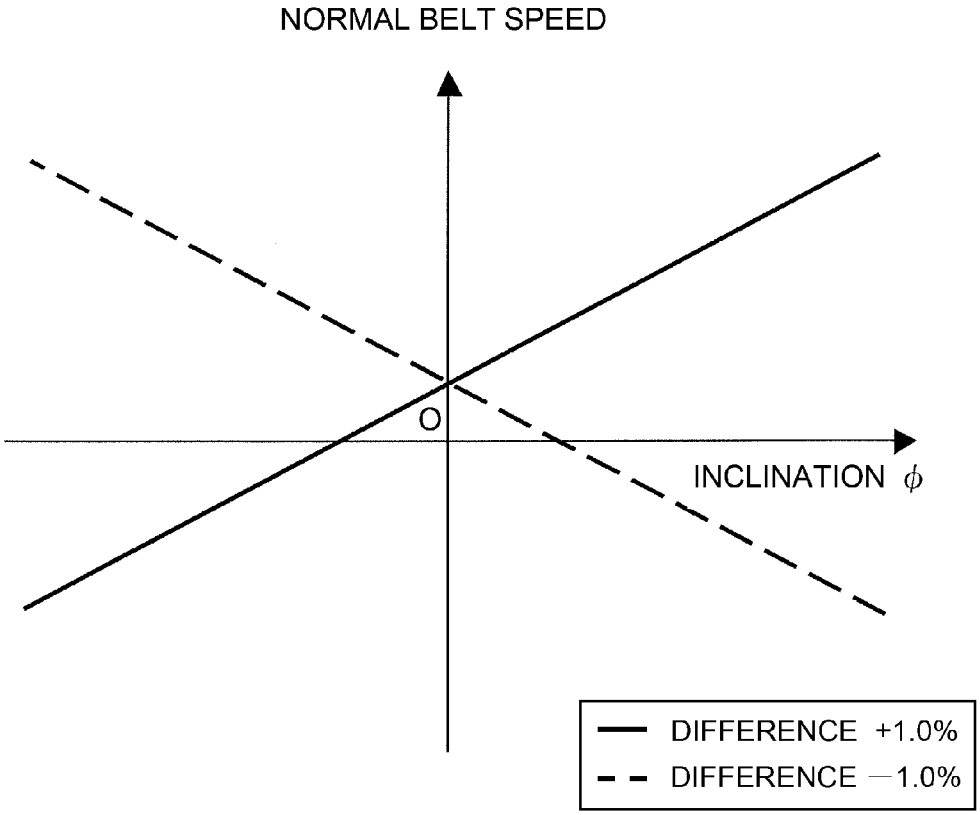
FIG. 12 is a graph showing the relationship between the angle of the intermediary transfer belt and the lateral shift speed of the belt.
Figure 13:
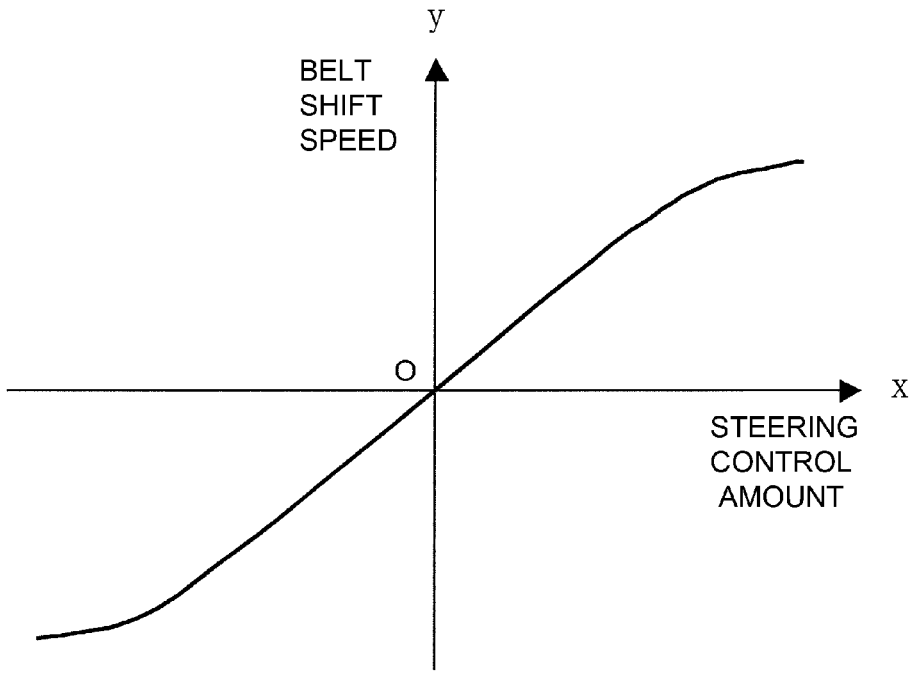
FIG. 13 is a graph showing the idealistic relationship between the lateral belt shift speed and the amount of belt steering.
Figure 14:
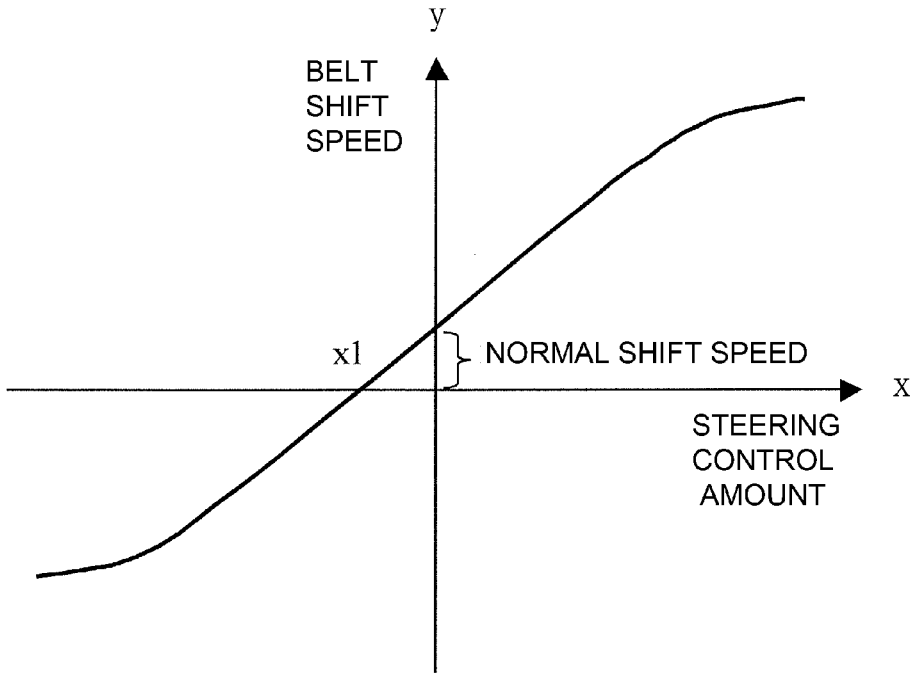
FIG. 14 is a graph showing the actual relationship between the lateral belt shift speed and the amount of belt steering.
Figure 15:
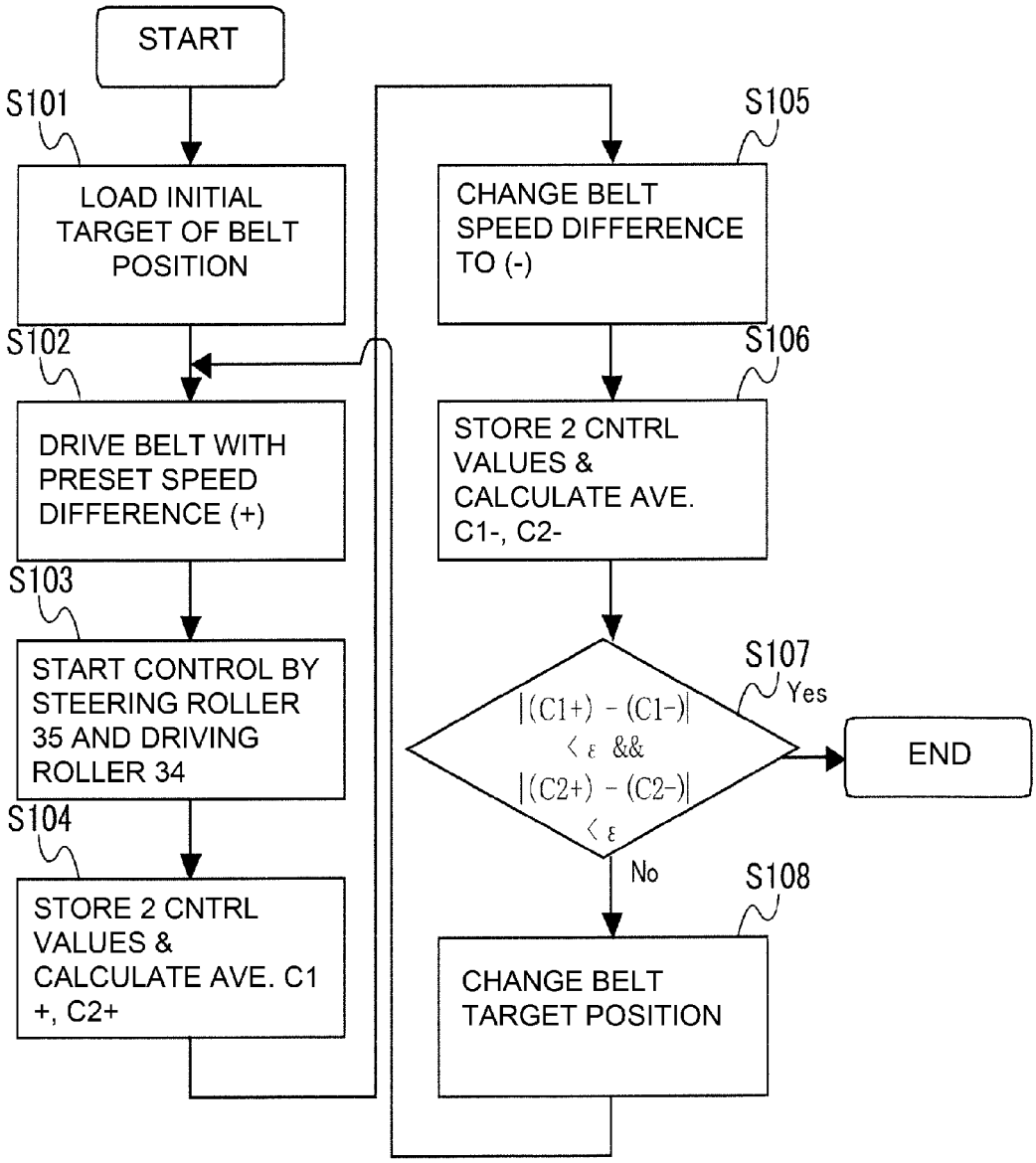
FIG. 15 is a flowchart of the control sequence for controlling, in attitude, the intermediary transfer belt when the image forming apparatus in the first embodiment is in the detection mode.
Figure 16:
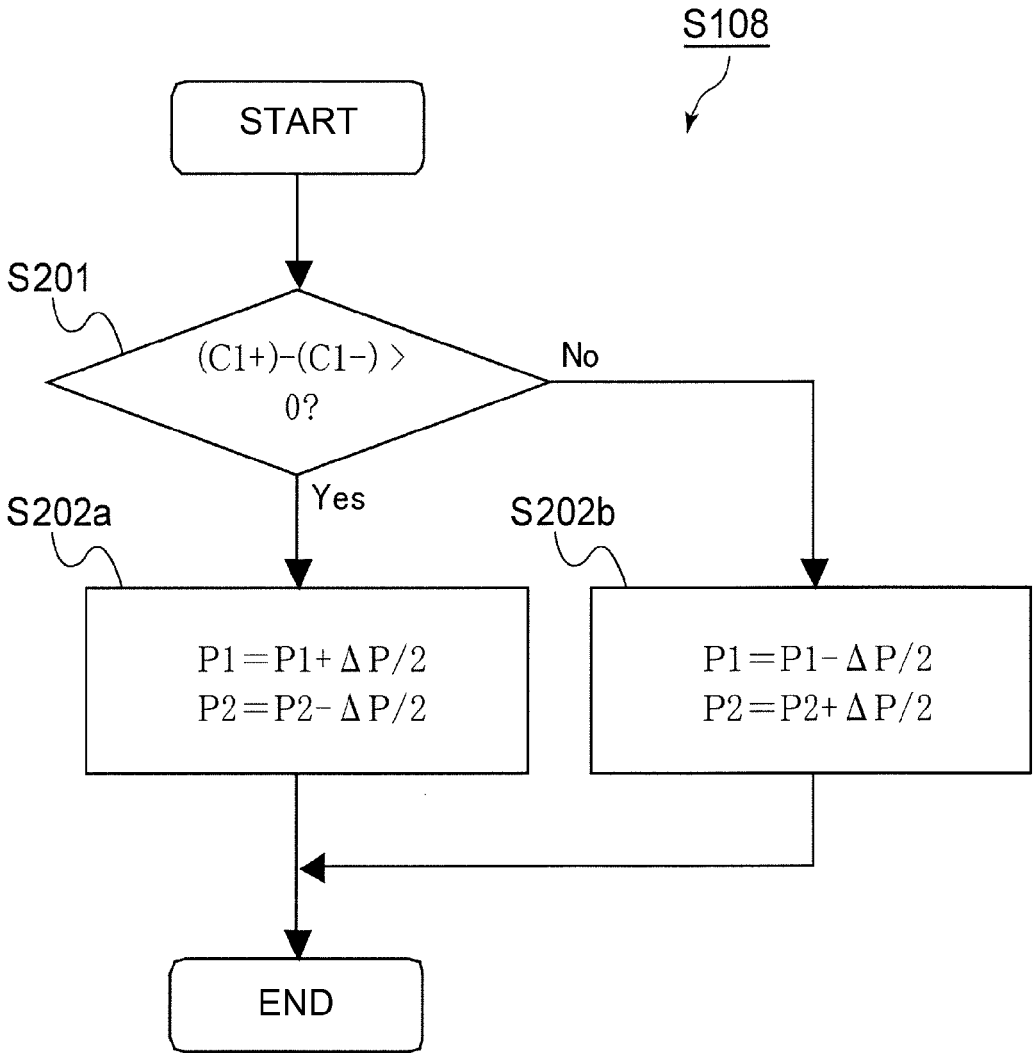
FIG. 16 is a flowchart of the control sequence for controlling, in attitude, the intermediary transfer belt when the image forming apparatus in the first embodiment is in the adjustment mode.

FIG. 11 is a drawing for describing how the speed of the intermediary transfer belt 31 is set relative to the photosensitive drum 30 in this embodiment. FIG. 12 is a graph which shows the relationship between the angle of tilt of the intermediary transfer belt 31 and the speed at which the intermediary transfer belt 31 shifts in the direction perpendicular to the rotational direction of the photosensitive drum 30. FIG. 13 is a graph which shows the idealistic relationship between the lateral belt shift speed and the amount of the steering of the intermediary transfer belt 31. FIG. 14 is an actual relationship between the lateral belt shift speed and the amount of the steering of the intermediary transfer belt 31. FIG. 15 is a flowchart of the control sequence for the detection mode in the first embodiment. FIG. 16 is a flowchart of the control sequence for the adjustment mode in the first embodiment.

Referring to FIG. 1, the intermediary transfer belt 31, which is an example of an endless belt, remains sandwiched between the photosensitive drum 30 which is an example of a cylindrical image bearing member, and the transfer roller 33 which is an example of an image transferring member. The image forming apparatus 1 can be changed in the speed of the intermediary transfer belt 31 relative to the speed of the photosensitive drum 30. The steering roller 35 which is an example of the first steering device controls the intermediary transfer belt 31 so that the intermediary transfer belt 31 converges to the first referential position in terms of the direction perpendicular to the rotational direction of the photosensitive drum 30. The driving roller 34 which is an example of the second steering device controls the intermediary transfer belt 31 so that the intermediary transfer belt 31 converges to the second referential position in terms of the direction perpendicular to the rotational direction of the photosensitive drum 30.

It controls the intermediary transfer belt 31 on the opposite side of the group of the four photosensitive drums 30 from the steering roller 35.

The control section 59 can make the image forming apparatus 1 operate in the detection mode which is for determining whether or not image formation is possible when the change in the amount of steering by at least one of the steering roller 35 and driving roller 34 remains within a preset range after the change in the speed of the intermediary transfer belt 31 relative to the speed of the photosensitive drum 30. In the detection mode, in which the image forming apparatus 1 is operated while the image forming apparatus 1 is not used for image formation, the first and second relative speeds (speed of intermediary transfer belt 31 relative to speed of photosensitive drum 30) are set, which are the same in absolute value, but opposite in sign (plus or minus), are set, and the amount of steering of at least one of the steering roller 35 and driving roller 34 is detected.

If the changes in the amount of steering at the first and second relative speeds are greater than the preset range, the control section 59, which is an adjustment device, can operate the image forming apparatus 1 in the adjustment mode in which at least one of the first and second referential positions is changed. Further, the control section 59 repeatedly operates the image forming apparatus 1 alternately in the detection mode and adjustment mode until the detected amount of steering converges to the preset range.

In the first embodiment, in the detection mode, the control section 59 sets the speed of the intermediary transfer belt 31 relative to the photosensitive drum 30 to two different value, and detects the angle of the intermediary transfer belt 31 relative to the rotational direction of the photosensitive drum 30 at the two speeds. If the angled of the intermediary transfer belt 31 is no less than the acceptable range, the control section 59 operates the image forming apparatus 1 in the adjustment mode to make the belt angle to converge to the acceptable range.

Referring to FIG. 11, the difference between the drum speed and belt speed, that is, the belt speed relative to the drum speed, is substantial, the intermediary transfer belt 31 is pushed in one of the two directions parallel to the rotational direction of the photosensitive drum 30 by the photosensitive drum 30, more specifically, the dynamic friction between the photosensitive drum 30 and intermediary transfer belt 31. The direction in which the intermediary transfer belt 31 is pushed by this external disturbing force is determined by the difference between the peripheral velocity of the photosensitive drum 30 and the moving speed of the outward surface of the intermediary transfer belt 31.

Referring to FIG. 11(*a*), when the speed of the outward surface of the intermediary transfer belt 31 is slower than the peripheral velocity of the photosensitive drum 30, the external disturbing force pushes the intermediary transfer belt 31 in the positive direction of the x axis of the coordinate. On the other hand, when the speed of the speed of the outward surface of the intermediary transfer belt 31 is slower than the peripheral velocity of the drum 30, the external disturbing force pushes the intermediary transfer belt 31 in the negative direction (opposite direction from the one shown in FIG. 11(*a*)) of the x axis of the coordinate as shown in FIG. 11(*b*).

It is assumed here that the moving direction of the intermediary transfer belt 31 is tilted by an angle $\phi$ relative to the direction in which the peripheral surface of the photosensitive drum 30 moves at the point of contact between the photosensitive drum 30 and intermediary transfer belt 31. In this case, the intermediary transfer belt 31 is pushed in the direction perpendicular to the rotational direction of the photosensitive drum 30 by the component of the external disturbing force attributable to the dynamic friction between the intermediary transfer belt 31 and photosensitive drum 30. The amount $F_{skew}$ of this component of the external disturbing force is expressed by the following equation, in which F stands for the amount of external disturbing force from the photosensitive drum 30:

$$F_{skew}=F\cdot\sin\phi\approx F\cdot\phi \quad (2).$$

When the speed of the outward surface of the intermediary transfer belt 31 is slower than the peripheral velocity of the photosensitive drum 30, the component $F_{skew}$ of the external disturbing force from the photosensitive drum 30 works in the positive direction of the axis v in FIG. 10 (local coordinate of intermediary transfer belt 31). When the speed of the outward surface of the intermediary transfer belt 31 is faster than the peripheral velocity of the photosensitive drum 30, the component $F_{skew}$ of the external disturbing force works in the negative direction of the axis v. These forces changes the speed at which the intermediary transfer belt 31 shifts in the direction perpendicular to the rotational direction of the photosensitive drum 30. Therefore, the direction in the intermediary transfer belt 31 shifts in the direction perpendicular to the rotational direction of the photosensitive drum 30 when the speed of the outward surface of the intermediary transfer belt 31 is slower than the peripheral velocity of the photosensitive drum 30 is opposite from the direction in the intermediary transfer belt 31 shifts in the direction perpendicular to the rotational direction of the photosensitive drum 30 when the speed of the outward surface of the intermediary transfer belt 31 is faster than the peripheral velocity of the photosensitive drum 30.

Referring to FIG. 12, the speed at which the intermediary transfer belt 31 laterally shifted was measured when the moving speed of the intermediary transfer belt 31 was made 1.0% faster than the peripheral velocity of the photosensitive drum 30, and when the moving speed of the intermediary transfer belt 31 was made 1.0% slower than the peripheral velocity of the photosensitive drum 30. As the angle (attitude) of the area (primary transfer surface) of the intermediary transfer belt 31, which is in contact with the photosensitive drum 30, relative to the direction (direction x in FIG. 11) of the line tangential to the photosensitive drum 30 at the point (primary transfer station) of contact between the photosensitive drum 30 and intermediary transfer belt 31 increases in absolute value, the constant speed at which the intermediary transfer belt 31 laterally shifts increases in absolute value. The constant lateral shift speed means the speed at which the intermediary transfer belt 31 laterally shifts when the steering roller 35 and driving roller 34 are not tilted, that is, when the steering roller 35 and driving roller 34 are kept parallel to the other rollers. The direction (direction x in FIG. 11) of the line which is tangential to the photosensitive drum 30 at the point of contact (primary transfer point (station)) between the photosensitive drum 30 and intermediary transfer belt 31 is perpendicular to the direction of the axial line of the photosensitive drum 30 (direction y in FIG. 11), and also, is perpendicular to the direction of the generatrix of the cylindrical photosensitive drum 30 (direction y in FIG. 11).

When the angle ϕ is very small, the $F_{skew}$ is expressed by Equation (2), which is a linear expression. Thus, the relationship between the lateral shift speed of the intermediary transfer belt 31 and the belt attitude (belt angle ϕ) is linear. The graph in FIG. 12 shows that even when the belt attitude (angle ϕ) is zero, the intermediary transfer belt 31 laterally shifts, although at a very slow speed. That is, not only is the intermediary transfer belt 31 pushed in the direction perpendicular to the rotational direction of the photosensitive drum 30 by the component of the external disturbing force attributable to the photosensitive drum 30, but also by the forces attributable to the deformation of the intermediary transfer unit (50 in FIG. 2), inaccuracy in the positioning of various rollers, and/or the like factors. Therefore, it is normal that the intermediary transfer belt 31 always laterally shifts. Further, the direction in which the intermediary transfer belt 31 laterally shifts when the moving speed of the intermediary transfer belt 31 is faster than the peripheral velocity of the photosensitive drum 30 is opposite to the direction in which the intermediary transfer belt 31 laterally shifts when the moving speed of the intermediary transfer belt 31 is slower than the peripheral velocity of the photosensitive drum 30. Therefore, the solid line in FIG. 12, which represents the lateral belt shift speed of the intermediary transfer belt 31 when the speed of the outward surface of the intermediary transfer belt 31 is faster than the peripheral velocity of the photosensitive drum 30, is opposite in sign (plus or minus) from the broken line in FIG. 12, which represents the lateral belt shift speed of the intermediary transfer belt 31 when the speed of the outward surface of the intermediary transfer belt 31 is slower than the peripheral velocity of the photosensitive drum 30. However, the two lines are roughly the same in absolute value, because the magnitude of the component of the external disturbing force attributable to the photosensitive drum 30 (which is one of the causes of the lateral shift of the intermediary transfer belt 31) when the speed of the outward surface of the intermediary transfer belt 31 is faster than the peripheral velocity of the photosensitive drum 30 is roughly the same as that when the speed of the outward surface of the intermediary transfer belt 31 is slower than the peripheral velocity of the photosensitive drum 30.

As the belt attitude ϕ becomes virtually zero, that is, as the direction in which the area (primary transfer surface) of the intermediary transfer belt 31, which is in contact with the photosensitive drum 30, moves (direction u in FIG. 11) becomes roughly parallel to the direction of the line tangential to the photosensitive drum 30 at the point (primary transfer station) of contact between the photosensitive drum 30 and intermediary transfer belt 31 (direction x in FIG. 11), the speed at which the intermediary transfer belt 31 laterally shifts when the intermediary transfer belt 31 is increased in speed relative to the photosensitive drum 30, and that when intermediary transfer belt 31 is decreased in speed relative to the photosensitive drum 30, become roughly the same. In the first embodiment, this knowledge is used to make the moving direction (direction u in FIG. 11) of the area (primary transfer surface) of the intermediary transfer belt 31, which is in contact with the photosensitive drum 30, roughly parallel to the direction (direction x in FIG. 11) of the line tangential to the photosensitive drum 30 at the point (primary transfer station) of contact between the photosensitive drum 30 and intermediary transfer belt 31.

Referring to FIG. 13, the speed (y) at which intermediary transfer belt 31 laterally shifts is proportional to the amount (x) by which the steering roller 35 is steered. Idealistically, when the amount of the steering of the intermediary transfer belt 31 is zero, the intermediary transfer belt 31 does not laterally shift. Thus, if the sequence for controlling the intermediary transfer belt 31 in lateral shift is carried out when the image forming apparatus 1 is in the idealistic condition, the intermediary transfer belt 31 becomes stable in position when the amount of the steering of the intermediary transfer belt 31 is zero, that is, when the steering roller 35 is in the position in which it does not make the intermediary transfer belt 31 laterally shift.

Next, referring to FIG. 14, in reality, the intermediary transfer belt 31 is subjected to various external disturbing forces. Therefore, even when the direction (direction u in FIG. 11) in which the area (primary transfer surface) of the intermediary transfer belt 31, which is in contact with the photosensitive drum 30, moves, is parallel to the direction (direction x in FIG. 11) of the line tangential to the photosensitive drum 30 at the point of contact (primary transfer station) between the photosensitive drum 30 and intermediary transfer belt 31, that is, even when the angle ϕ is zero, the intermediary transfer belt 31 laterally shifts more or less. Therefore, the curved line which shows the relationship between the amount (x) by which the steering roller 35 is steered, and the speed at which the intermediary transfer belt 31 laterally shifts, is displaced in the direction y by the amount equal to the normal lateral belt shift speed. When the amount of steering is x1, the speed at which the intermediary transfer belt 31 laterally shifts is zero. Therefore, if the sequence for controlling the lateral shift of the intermediary transfer belt 31 is carried out when the relationship between the amount of the steering of the intermediary transfer belt 31 and the lateral belt shift speed is as shown in FIG. 14, the intermediary transfer belt 31 becomes stable in position in terms of the direction perpendicular to the rotational direction of the photosensitive drum 30 when the amount of the steering of the intermediary transfer belt 31 is approximately x1.

The greater the speed of the normal lateral shift of the intermediary transfer belt 31, the greater the value (absolute value) of the equilibrium point x1 of the steering control. The relationship between the equilibrium point x1 and the speed of the normal lateral shift of the intermediary transfer belt 31 may be thought to be linear. Therefore, the speed of the normal speed of the lateral shift of the intermediary transfer belt 31 can be quantitatively grasped by detecting the amount of the steering of the steering roller 35 when the intermediary transfer belt 31 is stable in position in terms of the direction perpendicular to the rotational direction of the photosensitive drum 30 because of the steering amount control.

Referring to FIG. 10(*b*), in the first embodiment, the target values P1 and P2 are set for the position H, in terms of the direction perpendicular to the rotational direction of the photosensitive drum 30, to which the intermediary transfer belt 31 is to be moved when the intermediary transfer belt 31 is steered.

In the detection mode, the speed of the normal lateral shift of the intermediary transfer belt 31 is not detected directly. Instead, the amount of the steering of the steering roller 35 and/or driving roller 34 is detected in place of the speed of the normal lateral shift of the intermediary transfer belt 31. Also in the detection mode, the speed of the intermediary transfer belt 31 relative to the peripheral velocity of the photosensitive drum 30 is set to two different values. If the difference between the normal lateral shift speeds of the intermediary speed 31 indirectly measured at two difference speeds of the intermediary transfer belt 31 relative to the peripheral velocity of the photosensitive drum 30, one for one, is within an acceptable range, image formation is permitted. However, if it is beyond the acceptable range, the image forming apparatus 1 is operated in the adjustment mode, in which the target values P1 and P2 for the positions for the intermediary transfer belt 31 in terms of the direction perpendicular to the rotational direction of the photosensitive drum 30 are changed so that the direction (direction u in FIG. 11) in which the area (primary transfer surface) of the intermediary transfer belt 31, which is in contact with the photosensitive drum 30, moves, becomes roughly parallel to the direction (direction x in FIG. 11) of the line tangential to the photosensitive drum 30 at the point of contact (primary transfer station) between the photosensitive drum 30 and intermediary transfer belt 31. With this changes, the angle $\phi$ of the direction (direction u in FIG. 11) in which the area (primary transfer surface) of the intermediary transfer belt 31, which is in contact with the photosensitive drum 30, moves, relative to the direction (direction x in FIG. 11) of the line tangential to the photosensitive drum 30 at the point of contact (primary transfer station) between the photosensitive drum 30 and intermediary transfer belt 31 is made to converge to the acceptable range.

Referring to FIG. 3, the intermediary transfer belt 31 and transfer roller 33 are integral parts of the intermediary transfer unit 50 which is removable from the main assembly of the image forming apparatus 1. Therefore, they are separable from the photosensitive drum 30. It is before the first image forming operation to be carried out after the reinstallation of the removed intermediary transfer unit 50 that the control section 59 operates the image forming apparatus 1 in the detection mode and adjustment mode. The intermediary transfer unit 50 operates the image forming apparatus 1 in the detection mode also when the image forming apparatus 1 is started up for the first time in each day (while image forming apparatus 1 is started up as main switch of image forming apparatus 1 is turned on). It is possible for an operator to operate the image forming apparatus 1 in the detection mode through the service mode screen, by opening the service mode screen on the unshown control panel of the image forming apparatus 1.

Referring to FIG. 15 along with FIG. 6, the control section 59 reads the initial values P1 and P2 for the target positions for the intermediary transfer belt 31 in terms of the direction perpendicular to the rotational direction of the photosensitive drum 30, at the locations of the first and second sensors 38*a* and 38*b*, respectively (S101). More concretely, the initial values P1 i and P2 i are stored in a memory which is in connection to the control section 59 so that communication is possible between the memory and control section 59. Thus, the control section 59 reads the relevant data from this memory.

The control section 59 drives the intermediary transfer belt 31 and photosensitive drum 30 independently from each other (S102). Referring to FIG. 3, the target values for the speed for the belt driving motor controller 75 are set so that the speed of the outward surface of the intermediary transfer belt 31 becomes greater by a preset value than the peripheral velocity of the photosensitive drum 30.

In the first embodiment, the peripheral velocity of the intermediary transfer belt 31 is set to be 1.0% greater than that of the photosensitive drum 30. This setup is not mandatory. However, if the difference between the peripheral velocity of the intermediary transfer belt 31 and that of the photosensitive drum 30 is greater than a certain value, it is possible that the section for driving the intermediary transfer belt 31 and the section for driving the photosensitive drum 30 will be subjected to a large amount of load. On the other hand, if the difference is less than a certain value, it may be impossible to precisely set the values P1 and P2 when the target positions for the intermediary transfer belt 31 is to be set (S104). According to the knowledge which the inventors of the present invention possess, the difference is desired to be set to roughly several percent.

The control section 59 begins to control the intermediary transfer belt 31 in the amount of lateral shift, and attitude, with the use of the driving roller 34 and steering roller 35 (S103). As the intermediary transfer belt 31 becomes stable in position and attitude, the control section 59 averages the angles S1 outputted from the first controller 51, and the angles S2 outputted from the second controller 52, for a preset length of time (S104). Here, the average values will be referred to as C1+ and C2+, respectively, and the preset length of time is 4 seconds (length of time it takes for intermediary transfer belt 31 circularly moves one full turn).

The criterion for determining whether or not the intermediary transfer belt 31 is stable in position and attitude is that the difference between the position Y1 of the intermediary transfer belt 31 detected by the first sensor 38*a* and the value P1 remains within +5% of P1 for four seconds, and also, the difference between the position Y2 of the intermediary transfer belt 31 detected by the second sensor 38*b* remains within +5% of P2 for four seconds.

Then, the control section 59 changes the target value for the driving speed for the belt driving motor controller 75 so that the speed (peripheral velocity) of the outward surface of the intermediary transfer belt 31 becomes less by a preset value than the surface speed (peripheral velocity) of the photosensitive drum 30. The absolute value of the ratio by which the intermediary transfer belt 31 is made less in peripheral velocity than the photosensitive drum 30 is equal to the absolute value of the ratio by which the intermediary transfer belt 31 is made greater in peripheral velocity than the photosensitive drum 30 in 5102. In the first embodiment, the ratio by which the intermediary transfer belt 31 is made less in peripheral velocity than the photosensitive drum 30 is −1.0%.

As the intermediary transfer belt 31 becomes stable in position and attitude, the control section 59 averages the angles S1 outputted from the first controller 51, and the angles S2 outputted from the second controller 52, for a preset length of time as they were in 5104 (S106). Here, the average values will be referred to as C1− and C2−, respectively, and the preset length of time is 4 seconds (length of time it takes for intermediary transfer belt 31 circularly moves one full turn) as it was in the step S104.

As soon as the control section 59 finishes calculating the C1+, C2+, C1− and C2−, it calculates the difference between C1+and C1−, and the difference between C2+ and C2−. Then, it determines whether or not the differences satisfy the preset acceptable value $\epsilon$ (S107). The inequality used for the determination is as follows:

$$|(C1+)-(C1-)|<\epsilon \&\& |(C2+)-(C2-)|<\epsilon \quad (3)$$

Here, "&&" is an operator which means AND. In a step S107, instead of detecting the speed of the normal lateral shift of the intermediary transfer belt 31, the amount by which the steering roller 35 is controlled, and the amount by which the driving roller 34 is controlled, are detected. Then, the amount by which steering was controlled when the intermediary transfer belt 31 was greater in peripheral velocity than the photosensitive drum 30 was compared with that when the intermediary transfer belt 31 was less in peripheral velocity than the photosensitive drum 30, with the use of Inequality (3), in order to determine whether or not the two are roughly the same. In the first embodiment, the tolerable difference $\epsilon$ was set to 0.1 (mm). With the use of Inequality (3), whether or not the speed of the normal lateral shift when the intermediary transfer belt 31 is greater in peripheral velocity than the photosensitive drum 30 is roughly the same as that when the intermediary transfer belt 31 is less in peripheral velocity than the photosensitive drum 30 is indirectly determined.

If Inequality (3) is true, the control sections 59 end the detection mode. If it is not true, the control section 59 puts the image forming apparatus 1 in the adjustment mode, in which it sets new values P1 and P2 for the belt positions in terms of the direction perpendicular to the rotational direction of the photosensitive drum 30 (S108). Then, it returns to Step S102, and repeats the above described control sequence.

Next, referring to FIG. 16, in the adjustment mode, first, the control section 59 determines whether the difference between C1+ and C1− is plus or minus (S201). If the difference is plus, the control section 59 adds ΔP/2 to P1, which is the value of the target position for the lateral shift of the intermediary transfer belt 31 at the location of the first sensor 38*a*, and subtracts ΔP/2 from the P2, which is the value for the target position for the lateral shift of the intermediary transfer belt 31 at the location of the second sensor 38*b* (S202*a*). If the difference is minus, the control section 59 does the opposite, that is, it subtracts ΔP/2 from P1, and adds ΔP/2 to P2 (S202*b*).

Here, ΔP stands for a preset value (fixed value) by which the intermediary transfer belt 31 is changed in attitude. Through the above described computation, the attitude (angle) ϕ of the intermediary transfer belt 31, which corresponds to the difference between the values P1 and P2 for the target lateral shift positions for the intermediary transfer belt 31, can be changed by ΔP:

$$\phi = P1 - P2$$

$$\phi + \Delta P = (P1 + \Delta P/2) - (P2 - \Delta P/2).$$

In the first embodiment, the difference between the value P1 of the target position H for the lateral shift of the intermediary transfer belt 31 stored in advance in the memory, and the initial values P1 i introduced in Step S101, can be minimized by adding ΔP/2 to P1, and the difference between the value P2 of the target position H for the lateral shift of the intermediary transfer belt 31, and the P2 i introduced in Step S101, can be minimized by subtracting ΔP/2 from P2. This is effective to prevent the problem that when the center of the sensor range is selected as P1 i and P2 i, P1 and P2 fall outside the sensor range.

In the first embodiment, the memory (storing device) of the control section 59 stores the values obtained by averaging the control values of the first and second controllers 51 and 52 within the preset length of time. The control section 59 puts the image forming apparatus 1 in the adjustment mode in which it calculates the differences among the multiple values stored in the storing device, and changes the values of the target positions for the lateral shift of the intermediary transfer belt 31, by a preset value, based on the sign (plus or minus) of the difference.

In the adjustment mode, the control section 59 calculates the differences among the multiple values stored in the memory, and multiplies the differences by a preset proportional constant. Then, it changes the values for the target lateral shift of the intermediary transfer belt 31, based on the values obtained by the multiplication. Also in the adjustment mode, the control sequence is carried out while the image forming apparatus 1 is not used for image formation. That is, the control sequence is carried out immediately before an image forming operation is started, and then, with preset chronological intervals.

The control section 59 makes the direction (direction u in FIG. 11) in which the area (primary transfer surface) of the intermediary transfer belt 31, which is in contact with the photosensitive drum 30, moves, roughly parallel to the direction (direction x in FIG. 11) of the line tangential to the photosensitive drum 30 at the point of contact (primary transfer station) between the photosensitive drum 30 and intermediary transfer belt 31, as described above. As a result, even if the difference between the moving speed of the intermediary transfer belt 31 and the peripheral velocity of the photosensitive drum 30 is changed, the external disturbing force to which the intermediary transfer belt 31 is subjected by the photosensitive drum 30 ceases to change in magnitude and direction. In the first embodiment, a means based on the above described knowledge was provided to achieve the objective of making the moving direction of the intermediary transfer belt 31 (direction u in FIG. 11) roughly parallel to the direction (direction x in FIG. 11) of the line tangential to the photosensitive drum 30 at the point of contact between the photosensitive drum 30 and intermediary transfer belt 31.

In the first embodiment, the intermediary transfer belt 31 can be corrected in both attitude and position in terms of the direction perpendicular to the rotational direction of the photosensitive drum 30, at the same time, and also, the image forming apparatus 1 can be properly initialized in terms of the position of the intermediary transfer belt 31 in terms of the direction perpendicular to the rotational direction of the photosensitive drum 30, and the attitude of the intermediary transfer belt 31. In other words, the target value for the attitude (angle) of the intermediary transfer belt 31 can be set so that the moving direction (direction u in FIG. 11) of the intermediary transfer belt 31 becomes roughly parallel to the direction (direction x in FIG. 11) of the line tangential to the photosensitive drum 30 at the point of contact between the photosensitive drum 30 and intermediary transfer belt 31. Therefore, g the image forming apparatus 1 in this embodiment is unlikely to output images which suffer from the color deviation and/or unwanted geometrical characteristic (deformation), which is attributable to the problem that the moving direction of the intermediary transfer belt (31) is not parallel to the rotational direction of the photosensitive drum (30). Further, the first embodiment reduces the intermediary transfer belt 31 in the amount of the external disturbing force attributable to the photosensitive drum 30, and therefore, can reduce the length of time necessary for the adjustment, and also, can improve the image forming apparatus 1 in performance.

<Modified Version of Embodiment 1>

In the first embodiment, the above described control sequence was carried out based on the coordinate system described above. However, it is possible switch Step S202*a* and Step S202*b* in position, depending of the definition of the coordinate system. In other words, the first embodiment is not intended to limit the present invention in scope.

In the first embodiment, in Step S202, whether the difference is plus or minus was determined based on the difference between C1+ and C1−. However, it may be determined based on the difference between C2+ and C2−.

Also in the first embodiment, in Step S202*a* and Step S202*b*, ΔP/2 is added to P1, and ΔP/2 is subtracted from P2. However, either ΔP may be added to P1, or subtracted from P2:

$$\phi + \Delta P = (P1 + \Delta P) - P$$

$$\phi + \Delta P = P1 - (P2 - \Delta P).$$

Further, in the first embodiment, the center of the belt position detection range of the first sensor 38*a*, and the center of the belt position detection range of the second sensor 38*b*, were used as the values for the initial target belt positions. However, the method for setting values for the initial belt positions does not need to be limited to the one in the first embodiment.

Moreover, in the first embodiment, it is immediately after the image forming apparatus 1 is operated in the detection mode that the image forming apparatus 1 is subjected to the normal lateral belt shift control and is operated in the adjustment mode. However, the control sequence for setting the initial positions for the intermediary transfer belt 31 does not need to be carried out every time the image forming apparatus 1 is started up. For example, it may be for every preset length of time, beside during image formation that a control such as the one in the first embodiment is executed. Using such control sequence can reduce the length of time for the operations other than image forming operations.

Further, in the first embodiment, in the normal belt shift control mode and adjustment mode, the intermediary transfer belt 31 is indirectly controlled in attitude by controlling the intermediary transfer belt 31 in position, in terms of the direction perpendicular to the rotational direction of the photosensitive drum 30, with the use of both the steering roller 35 and driving roller 34 (steering both steering roller 35 and driving roller 34). However, the intermediary transfer belt 31 may be directly controlled in attitude with the use of only one of the two rollers 35 and 34. In such a case, all that is necessary is to make the control section to calculate the difference between the value which indicates the belt position, in terms of the direction perpendicular to the rotational direction of the photosensitive drum 30, provided by the first sensor, and the value which indicates the belt position provided by the second sensor, calculate the angle $\phi$ based on the difference, and tilt either the steering roller 35 or driving roller 34, based on the result of the calculation.

Also in the first embodiment, the belt position was accurately detected using the above described marks. However, the control in the first embodiment can be executed with the use of one of the ordinary methods for detecting belt edges. In such a case, all that is necessary is to detect the belt edges with two different timings, or to find the profile of the belt edge in advance and adjusts the detected belt edge position based on the belt edge profile. With the employment of this method, it is possible to accurately obtain the amount of the skewness of the intermediary transfer belt 31, without being affected by the profile (shape) of the edges of the intermediary transfer belt 31. In particular, in the case where the belt edge profile is obtained to correct the detected belt position, various components related to the errors in belt position detection can be eliminated by averaging the outputs of each sensor, and therefore, the amount of lateral belt shift can be more reliably obtained.

<Embodiment 2>

Figure 17:
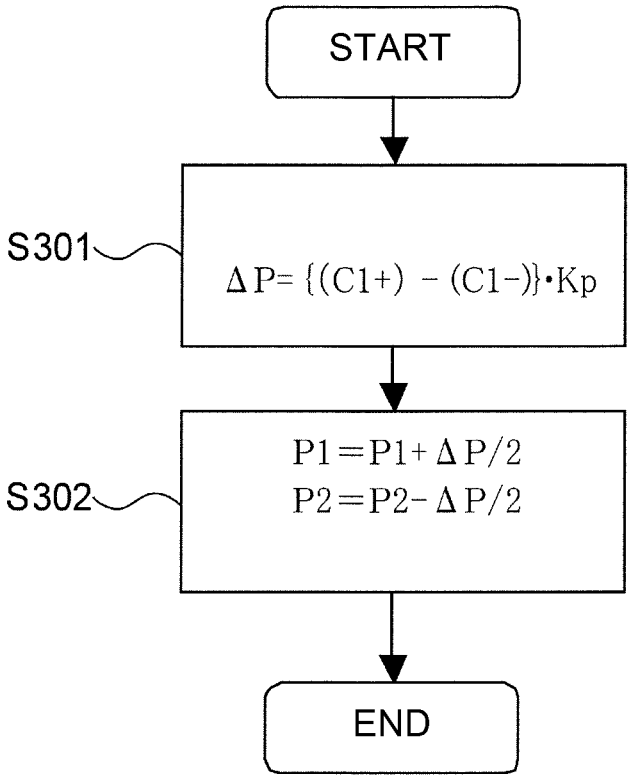
FIG. 17 is a flowchart of the control sequence for controlling, in attitude, the intermediary transfer belt when the image forming apparatus in the second embodiment is in the adjustment mode.

FIG. 17 is a flowchart of the control sequence in the adjustment mode in the second embodiment of the present invention. The second embodiment is different from the first embodiment in that the adjustment mode has the control sequence shown in FIG. 17 instead of the one shown in FIG. 16, which is the control sequence carried out in Step S108 shown in FIG. 15. Otherwise, the second embodiment is the same as the first embodiment, in the structure of the image forming apparatus 1 and the sequence for controlling the intermediary transfer belt 31 in position and attitude. Thus, in order not repeat the same descriptions, the second embodiment is described above, only the portions of the control sequence, which are different from the counterparts in the first embodiment are described.

Referring to FIG. 17, the control section 59 calculates the amount $\Delta P$ of the belt attitude change which is proportional to the amount of difference between C1+ and C2−, with the use of the following equation (S201):

$$\Delta P=\{(C1+)-(C1-)\}\times KP \tag{4}$$

In the second embodiment, the belt attitude (angle) at which the intermediary transfer belt 31 stabilized in position and attitude is calculated while a control sequence which is referred to as "proportional control sequence" in the field of control engineering is executed. KP in Equation (4) is a proportional gain, for which such a value that does not make the flow diverge is selected.

The control section 59 adds $\Delta P/2$ to the belt position target value P1 at the location of the first sensor 38*a*, and subtracts $\Delta P/2$ from the belt position target value P2 at the location of the second sensor 38*b* (S302).

<Embodiment 3>

Figure 18:
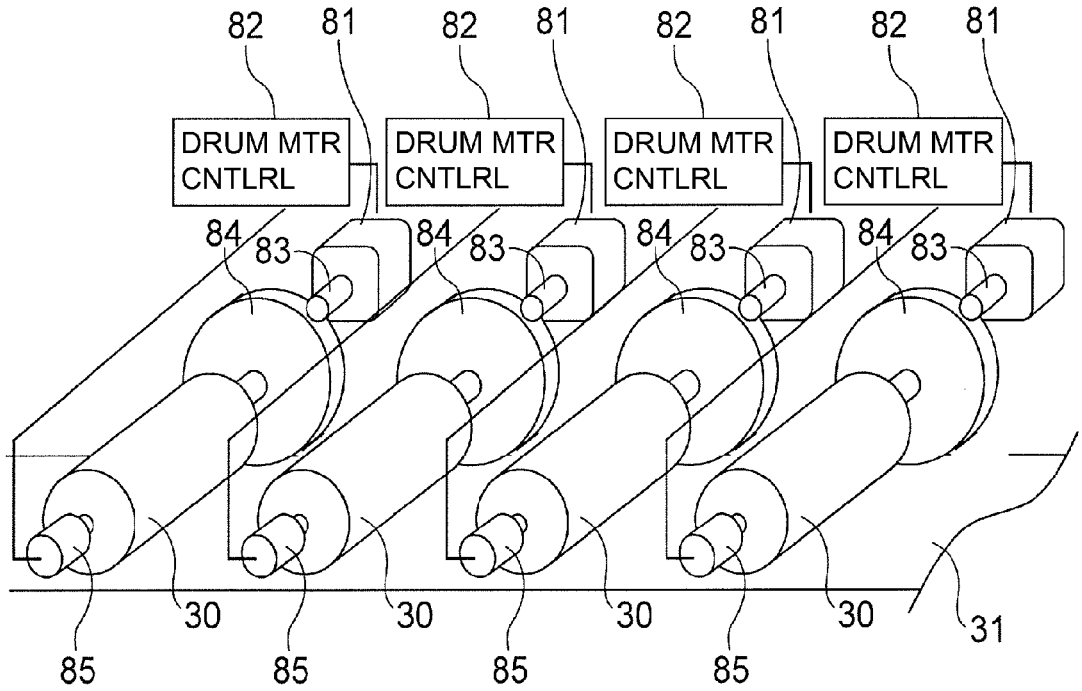
FIG. 18 is a schematic perspective view of the structural arrangement of the intermediary belt unit of the image forming apparatus in the third embodiment of the present invention, which is for operating the apparatus in the detection mode.
Figure 19:
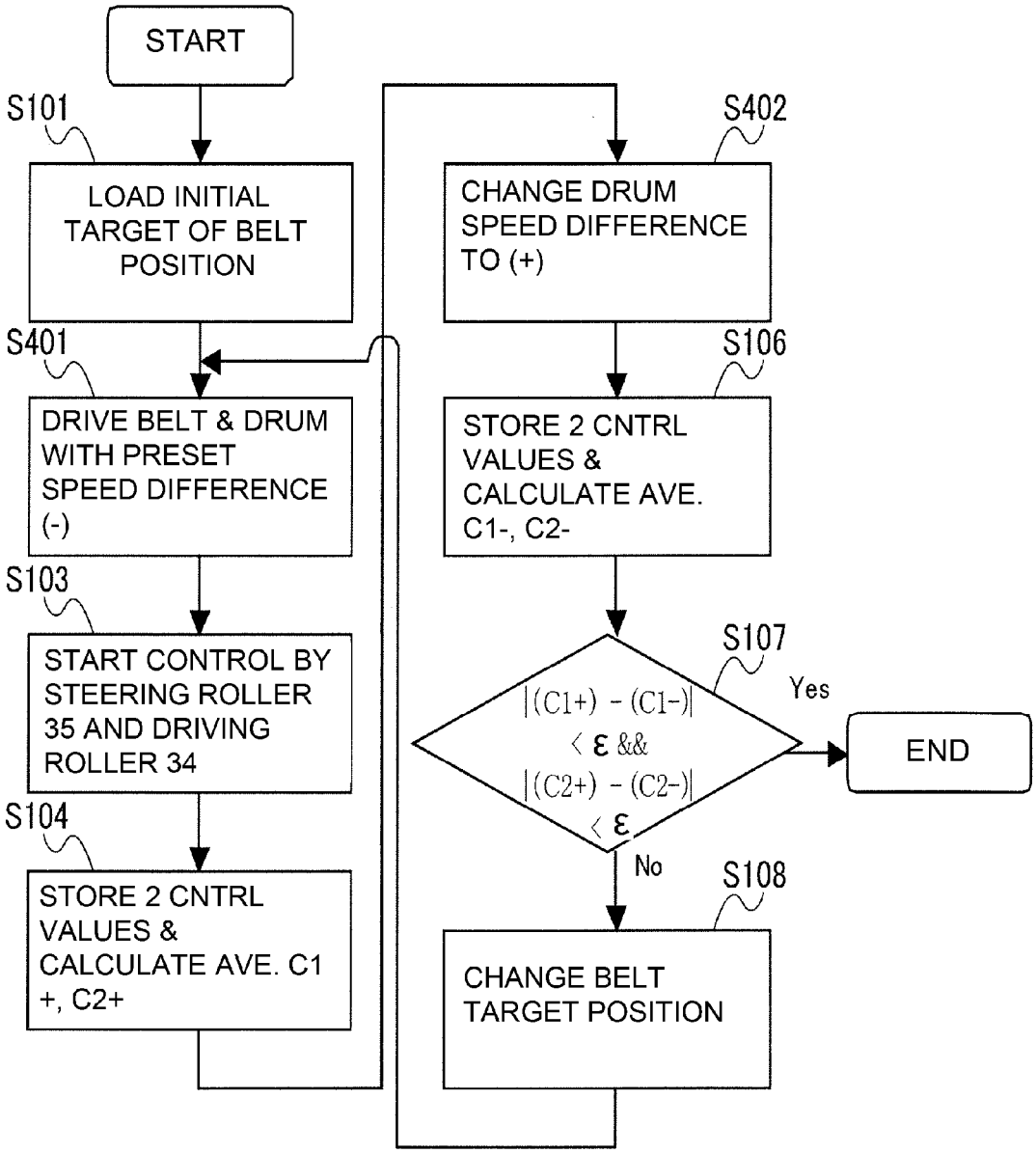
FIG. 19 is a flowchart of the control sequence for controlling, in attitude, the intermediary transfer belt when the image forming apparatus in the third embodiment is in the detection mode.

FIG. 18 is a schematic drawing for describing the structure of the portion of the image forming apparatus 1 in the third embodiment, which is for operating the image forming apparatus 1 in the detection mode. FIG. 19 is a flowchart of the control sequence carried out in the detection mode in the third embodiment.

In the first embodiment, the intermediary transfer belt 31 was changed in speed, in the Steps S102 and 5105 in the flowchart of the control sequence in the detection mode shown in FIG. 15. In comparison, in the third embodiment, the photosensitive drum 30 was changed in peripheral velocity to make the intermediary transfer belt 31 different in peripheral velocity from the photosensitive drum 30: the peripheral velocity of the photosensitive drum 30 was set to two different values to provide two differences in peripheral velocity between the intermediary transfer belt 31 and photosensitive drum 30. Otherwise, the third embodiment is the same as the first embodiment in terms of the structure of the image forming apparatus 1 and the control sequence. Thus, the structural components, portions, etc., of the image forming apparatus 1 in this embodiment, which are the same as the counterparts in the first embodiment are given the same referential codes as those used in FIG. 3, one for one, and are not going to be described here in order not to repeat the same descriptions.

Referring to FIG. 18, a drum driving motor gear 83 is solidly attached to the drive shaft of the photosensitive drum driving motor for driving the photosensitive drum 30. To the shaft of the photosensitive drum 30, a drum gear 84 is solidly attached. The drum driving motor gear 83 and drum gear 84 are positioned so that they mesh with each other. The torque from the photosensitive drum driving motor 81 is transmitted to the photosensitive drum 30 through a gear train made up of the abovementioned gears.

The opposite end of the shaft of the photosensitive drum 30 from the drum gear 84 is in connection to the drum rotary encoder 85, which detects the angular velocity of the photosensitive drum 30 with preset intervals. The drum rotary encoder 85 in this embodiment of the transmission type, and employs a disc with a slit. It is similar to the belt rotary encoder 74, shown in FIG. 3.

The drum driving motor controller 82 controls (feedback control) the speed of the photosensitive drum driving motor 81, based on the series of pulses outputted from the drum rotary encoder 85. The image forming apparatus 1 is structured so that the speed of the photosensitive drum driving motor 82 can be set to any value. Therefore, the difference in peripheral velocity between the intermediary transfer belt 31 and photosensitive drum 30 can be set to any value while keeping the intermediary transfer belt 31 moving at a preset velocity.

Referring to FIGS. 18 and 1 along with FIG. 19, the control section 59 sets two target values P1 and P2 for belt position in order to control the intermediary transfer belt 31 in attitude.

The control section 59 reads the previous target values P1 and p2 for belt position, as in the first embodiment, and sets the belt position to P1 and P2, and starts driving the photosensitive drum 30 and intermediary transfer belt 31 (S101).

Then, the control section 59 changes the peripheral velocity of the photosensitive drum 30 to one of the preselected speeds while keeping the intermediary transfer belt 31 moving at the preset velocity (S401). The value set for the drum driving motor controller 81 to change the peripheral velocity of the photosensitive drum 30 is such a value that makes the peripheral velocity of the photosensitive drum 30 smaller by a preset value than the peripheral velocity of the intermediary transfer belt 31. In the third embodiment, the peripheral velocity of the photosensitive drum 30 was made 1.0% less than that of the intermediary transfer belt 31. However, this is not mandatory.

The control section 59 waits until the intermediary transfer belt 31 is stabilized in position and attitude by the belt steering by the steering roller 35 and driving roller 34 (S103), and obtains the average value C1+ and C2+ of the amount of steering by the steering roller 35 and driving roller 34, respectively (S104).

Thereafter, the control section 59 changes the target value to be set for the drum driving motor controller 82 so that the peripheral velocity of the photosensitive drum 30 becomes greater by a preset value than the speed of the outward surface of the intermediary transfer belt 31 (S402). The absolute value of the ratio of velocity increase is the same as that set in Step S401, which is +1.0%.

Then, the control section 59 waits until the intermediary transfer belt 31 becomes stable in position and attitude by being steered by the steering roller 35 and driving roller 34. Then, it obtains the average values C1− and C2− of the amounts of steering by the steering roller 35 and driving roller 34 (S106). Then, the control section 59 determines whether or not the difference between the average values is within an acceptable range or not (S107). If it is greater than the acceptable range, the control section 59 operates the image forming apparatus 1 in adjustment mode (S108). If it is within the acceptable range, the control section 59 allows the image forming apparatus 1 to form images (Yes in S107).

Given above are the detailed descriptions of the embodiments of the present invention. However, the present invention is applicable to any image forming apparatus as long as the apparatus is provided with two steering rollers and can be operated in the mode in which its belt can be corrected in attitude (skewness) by the adjustment of the target values for the amount of steering for the two steering rollers, even if the apparatus is partially or entirely different in structure from the image forming apparatuses in the preceding embodiments.

In other words, the present invention is applicable to any image forming apparatus as long as the apparatus is provided with two steering rollers and can correct its belt in attitude (skewness) with the use of the two steering roller, whether the apparatus is of the tandem or single drum type, and/or of the intermediary transfer or direct transfer type. In the preceding description of the embodiments of the present invention, only the main portions of the image forming apparatus, that is, the portion of the image forming apparatus which are related to the formation and transfer of a toner image, were described. However, the present invention is also applicable to various versions of image forming apparatus, such as a printer, a copying machine, a facsimile machine, a multifunction machine, etc., which are combinations of the above described main portions of the image forming apparatus, and various additional devices, equipments, frames, and the like structural components.

While the invention has been described with reference to the structures disclosed herein, it is not confined to the details set forth, and this application is intended to cover such modifications or changes as may come within the purposes of the improvements or the scope of the following claims. This application claims priority from Japanese Patent Application No. 138267/2011 filed Jun. 22, 2011 which is hereby incorporated by reference.

What is claimed is:

1. An image forming apparatus comprising:

photosensitive members;

image forming devices configured to form toner images on said photosensitive members, respectively;

a belt unit including at least an endless belt movable in contact with said photosensitive members and a first roller and a second roller rotatably supporting said endless belt;

a first sensor configured to detect a position of said endless belt with respect to a widthwise direction thereof;

a first inclining device configured to incline said first roller so that an output of said first sensor is kept at a first target value;

a second sensor configured to detect the position of said endless belt with respect to the widthwise direction;

a second inclining device configured to incline said second roller so that an output of said second sensor is kept at a second target value;

an execution portion configured to execute, in a period in which said image forming devices do not form the toner images, a first test mode in which a peripheral speed of said photosensitive members is slower than a peripheral speed of said endless belt and a second test mode in which the peripheral speed of said photosensitive members is faster than the peripheral speed of said endless belt, wherein in each of the first test mode and the second test mode, said first inclining device and said second inclining devices are controlled so that an output of said first sensor keeps a first target value, and an output of said second sensor keeps a second target; and an adjusting portion configured to adjust each of the first target value and the second target value for formation of the toner images of said image forming devices on the basis of an inclination value of said first roller in the first test mode and an inclination value of said first roller in the second test mode and on the basis of an inclination value of said second roller in the first test mode and an inclination value of said second roller in the second test mode.

2. The image forming apparatus according to claim 1, wherein said belt unit is detachably mountable to said image forming apparatus, and said adjusting portion adjusts the first target value and the second target value in response to mounting of said endless belt to said image forming apparatus.

3. The image forming apparatus according to claim 1, wherein said first sensor is disposed adjacent to said first roller, and said second sensor is disposed adjacent to said second roller.

4. The image forming apparatus according to claim 1, wherein said first inclining device displaces one axial end portion side of said first roller thereof relative to the other end portion side thereof, and said second inclining device displaces one axial end portion side of said second roller thereof relative to the other end portion side thereof.

5. The image forming apparatus according to claim 1, further comprising primary transfer devices for transferring the toner images formed on the photosensitive members onto said endless belt, and a secondary transfer device for transferring the toner images transferred onto said endless belt onto a recording material.

6. The image forming apparatus according to claim 5, wherein toner images formed on the photosensitive members are transferred onto said endless belt sequentially and superimposedly by said primary transfer devices, and the toner images transferred onto said endless belt are transferred all together onto the recording material by said secondary transfer device.

7. The image forming apparatus according to claim 1, wherein the adjusting portion adjusts each of the first target value and the second target value when at least one of a difference between the inclination value of said first roller in the first test mode and the inclination value of said first roller in the second test mode and a difference between the inclination value of said second roller in the first test mode and the inclination value of said second roller in the second test mode is not less than a predetermined tolerance.

8. The image forming apparatus according to claim 1, wherein the adjusting portion adjusts the first target value and the second target value by adding to or deducting from the first target value and the second target value before adjustment, a predetermined value.

* * * * *